US006302656B1

(12) United States Patent
Hirota

(10) Patent No.: US 6,302,656 B1
(45) Date of Patent: Oct. 16, 2001

(54) SOLENOID CONTROLLED VALVE AND VARIABLE DISPLACEMENT COMPRESSOR

(75) Inventor: Hisatoshi Hirota, Tokyo (JP)

(73) Assignee: TGK Co. Ltd., Tokyo (JP)

( * ) Notice: Subject to any disclaimer, the term of this patent is extended or adjusted under 35 U.S.C. 154(b) by 0 days.

(21) Appl. No.: 09/412,144

(22) Filed: Oct. 5, 1999

(30) Foreign Application Priority Data

| | | |
|---|---|---|
| Oct. 8, 1998 | (JP) | 10-286147 |
| Nov. 20, 1998 | (JP) | 10-330608 |
| Mar. 25, 1999 | (JP) | 11-080772 |
| May 13, 1999 | (JP) | 11-132081 |
| Jun. 8, 1999 | (JP) | 11-160307 |

(51) Int. Cl.[7] ..... F04B 1/26
(52) U.S. Cl. ..... 417/222.2
(58) Field of Search ..... 417/222.2, 213, 417/269; 25/129.15; 474/93; 62/115, 133, 212

(56) References Cited

U.S. PATENT DOCUMENTS

| | | | | |
|---|---|---|---|---|
| 4,747,754 | * | 5/1988 | Fujii et al. | 417/222.2 |
| 5,702,235 | * | 12/1997 | Hirota et al. | 417/222.2 |
| 5,975,859 | * | 11/1999 | Kawaguchi et al. | 417/222.2 |
| 6,010,312 | * | 1/2000 | Suitou et al. | 417/222.2 |

* cited by examiner

*Primary Examiner*—Teresa Walberg
*Assistant Examiner*—Quang Van
(74) *Attorney, Agent, or Firm*—Nilles & Nilles SC

(57) ABSTRACT

A solenoid controlled valve for controlling the displacement of a variable displacement compressor the moveable iron core and the valve driving rod actuating the valve responsible for the displacement of the compressor are provided between said valve and a pressure sensitive part which is actuated by the suction chamber pressure, so that with the solenoid de-energized the valve is kept open by the force of an operational spring while said differential pressure acting at said pressured sensitive part is hindered to act upon said valve. In a valve combinaton of a solenoid controlled valve and a valve for opening or closing a suction passage between a low-pressure refrigerant piping conduit and the suction chamber said valve is controlled directly by said solenoid controlled valve and by refrigerant pressure without a mechanical transmission mechanism.

8 Claims, 31 Drawing Sheets

SOLENOID CONTROLLED VALVE AND VARIABLE DISPLACEMENT COMPRESSOR

BACKGROUND OF THE INVENTION

1. Field of the Invention

The present invention relates to a solenoid controlled valve for a and to a variable displacement compressor used for compressing refrigerant in a refrigeration cycle of an automobile air conditioner or the like.

Since the compressor of a refrigeration cycle of an automobile air conditioner is directly connected to the engine by a belt, the speed of the compressor cannot be controlled independently. So, conventionally a variable displacement compressor is used apt to change the amount of refrigerant (the amount of discharge) to obtain appropriate cooling capacity without being restricted by the driving speed of the engine. In the variable displacement compressor, a swing plate with a variable angle of inclination is installed in an airtight crank chamber. The swing plate is driven by rotational movement of an axis of rotation and executes a swing movement. A piston coupled to the swing plate executes reciprocal motions and is received within a cylinder so that it sucks refrigerant from a suction chamber connected to a low-pressure refrigerant pipe conduit into said cylinder, compresses it, and discharges it into a discharge chamber connected to a high-pressure refrigerant pipe conduit. The amount of discharge of the refrigerant is varied by changing the angle of inclination of the swing plate in accordance to a variation of the pressure in the crank chamber. The pressure in the crank chamber is controlled by a solenoid controlled valve. The variable displacement compressor continues to operate with a minimum displacement which is about 5% of the maximum displacement even when there is no cooling demand. That is, the compressor is then operating at its minimum operation state. However, if operated like that the problem occurs that fins of an evaporator supplied with refrigerant by the compressor are freezing when the load is small as in winter even at the minimum operation state, due to the flow of compressed refrigerant into the evaporator.

2. Description of the Related Art

It is known to install a valve in a suction passage extending between the low-pressure refrigerant pipe conduit and the suction chamber which valve closes at the minimum operation state, thereby preventing low-pressure refrigerant from being sucked into the compressor. In a conventional variable displacement compressor the swing plate is driving said valve for opening and closing the suction passage. When the swing plate is driving the valve for opening and closing the suction passage it is necessary to install a mechanical transmission mechanism between the swing plate in the crank chamber and the valve in the suction passage which is provided outside of the crank chamber. Said mechanical transmission mechanism needs proper sealing between the crank chamber and the valve so the transmission mechanism is complicated due to these problems.

Furthermore, instead a solenoid controlled valve can be provided which then is responsible for varying the pressure in the crank chamber to vary the amount of displacement. A known solenoid controlled valve for that purpose comprises a pressure sensitive part between the moveable iron core of the solenoid and the valve controlling the pressure in the crank chamber. The pressure sensitive part is actuated by the varying suction chamber pressure. When de-energising the solenoid the spring force of the spring for operation urging the valve in opening direction should suffice to maintain said valve in its open state and so that the pressure in the crank chamber will correspond to the pressure in the discharge chamber and the compressor should remain in the minimum operation state. However, since the pressure sensitive part is actively situated between the moveable iron core of the solenoid and the valve actuating rod a change of the suction chamber pressure may lead to a response of said pressure sensitive part resulting in an actuation of the valve into or towards its closed state. So, it is impossible to keep the compressor in the steady operation state of the minimum displacement. It is necessary to separately provide a clutch or the like in a driving part of the compressor resulting in an increase of the overall costs.

OBJECTS AND SUMMARY OF THE INVENTION

Therefore, it is an object of the present invention to improve a variable displacement compressor such that it safely remains in a steady operation state of the minimum displacement without a clutch or the like, which has compact dimensions and which does not need a mechanical transmission mechanism between the swing plate and the valve in the suction passage.

Said objects can be achieved by the features of claim 1 and by the features of independent claim 8.

By the solenoid controlled valve and the arrangement of the pressure sensitive part such that it is separated from the valve controlling the pressure in the crank chamber when the solenoid is de-energized a significant variation of the suction chamber pressure forcing the pressure sensitive part to respond cannot create a force influencing the open state of the valve. The valve reliably maintains its open state. The compressor performs a steady operation in the minimum discharge state.

If the valve in the suction passage according to independent claim 8 is controlled by the solenoid controlled valve while the latter simultaneously is controlling the amount of discharge of refrigerant in the minimum state, the valve in the suction passage is brought to a closed state when the solenoid of the solenoid controlled valve is de-energized so that no refrigerant from the low-pressure pipe conduit is sucked into the compressor and is supplied to the evaporator. This avoids freezing of the fins of the evaporator even with low load as e.g. in winter. A mechanical transmission mechanism between the swing plate and the valve in the suction passage is no longer necessary.

With the solenoid controlled valve, when the solenoid is de-energized, a differential pressure between a predetermined reference pressure and the pressure in the suction chamber connecting part at the pressure sensitive part does not act on the valve in its closing direction so that the valve keeps communication open between the discharge chamber connecting part and the crank chamber connecting part. It is thus possible to keep the compressor in a steady operation state of the minimum displacement without using a clutch or the like. Moreover, it is possible to keep the dimensions of the arrangements and particularly the valve compact without using a bellows or the like.

Irrespective of the type of variable displacement compressor the valve in the suction passage between the low-pressure refrigerant pipe conduit and the suction chamber is brought to a closed state as soon as the solenoid of the valve is de-energized and while the valve controls the amount of discharge of refrigerant to the minimum state. Therefore, it is possible to drive the valve in the suction passage by a simple structure without using mechanisms and the like which extend from the inside of the crank chamber to the outer side thereof.

Preferred embodiments are contained in the depending claims.

BRIEF DESCRIPTION OF THE DRAWINGS

Embodiments of the invention as well as an example of a prior art solenoid controlled valve will be explained with the help of the drawings. In the drawings is:

FIGS. 8 and 11, in a state of maximum displacement and a state of the minimum displacement, respectively;

DESCRIPTION OF THE PREFERRED EMBODIMENTS

Figure 2:
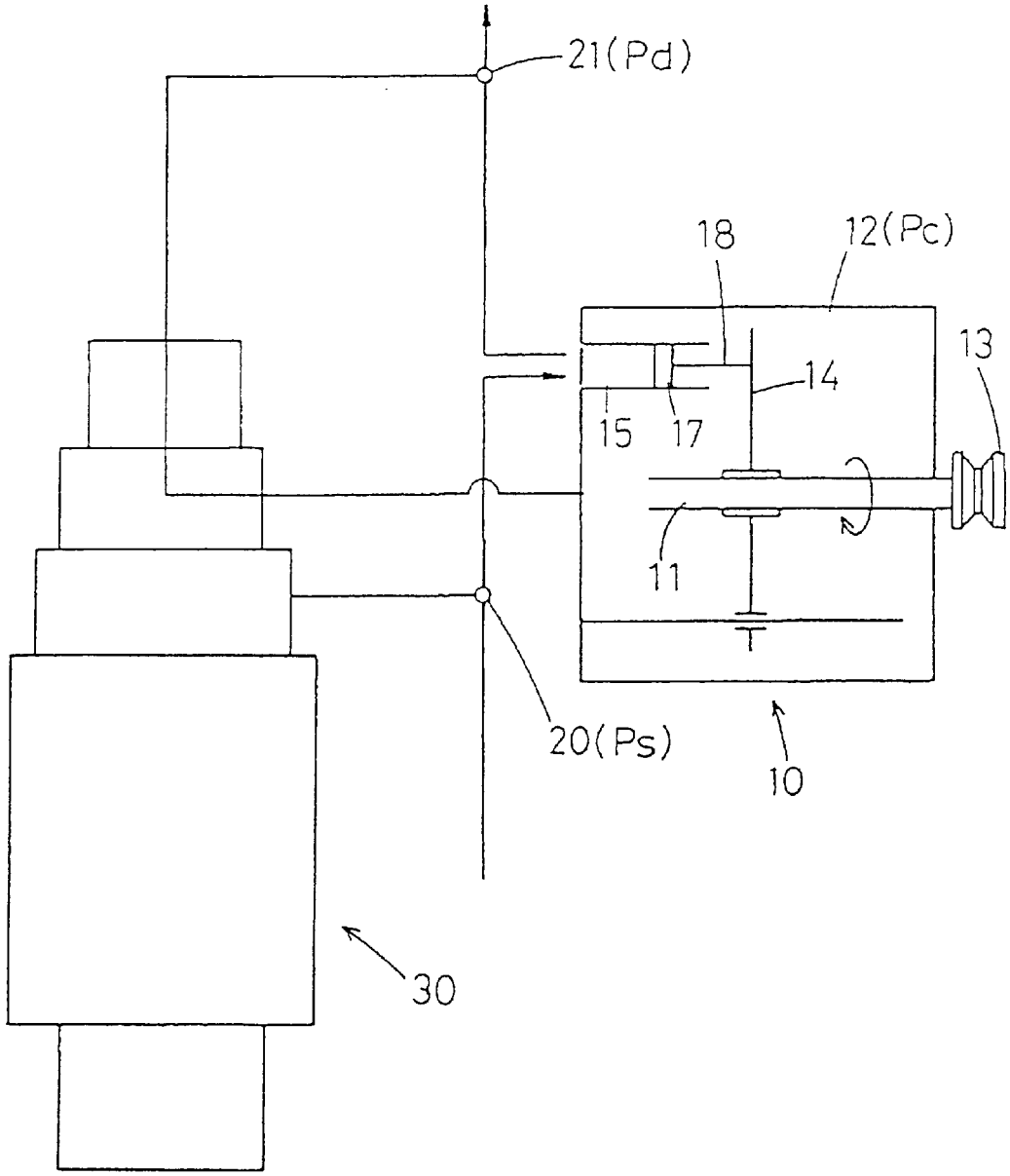
FIGS. 2 and 3 block diagrams of a variable displacement compressor equipped with a displacement control apparatus, namely a solenoid controlled valve, in an operation state of minimum displacement and an operation state of maximum displacement, respectively.
Figure 3:
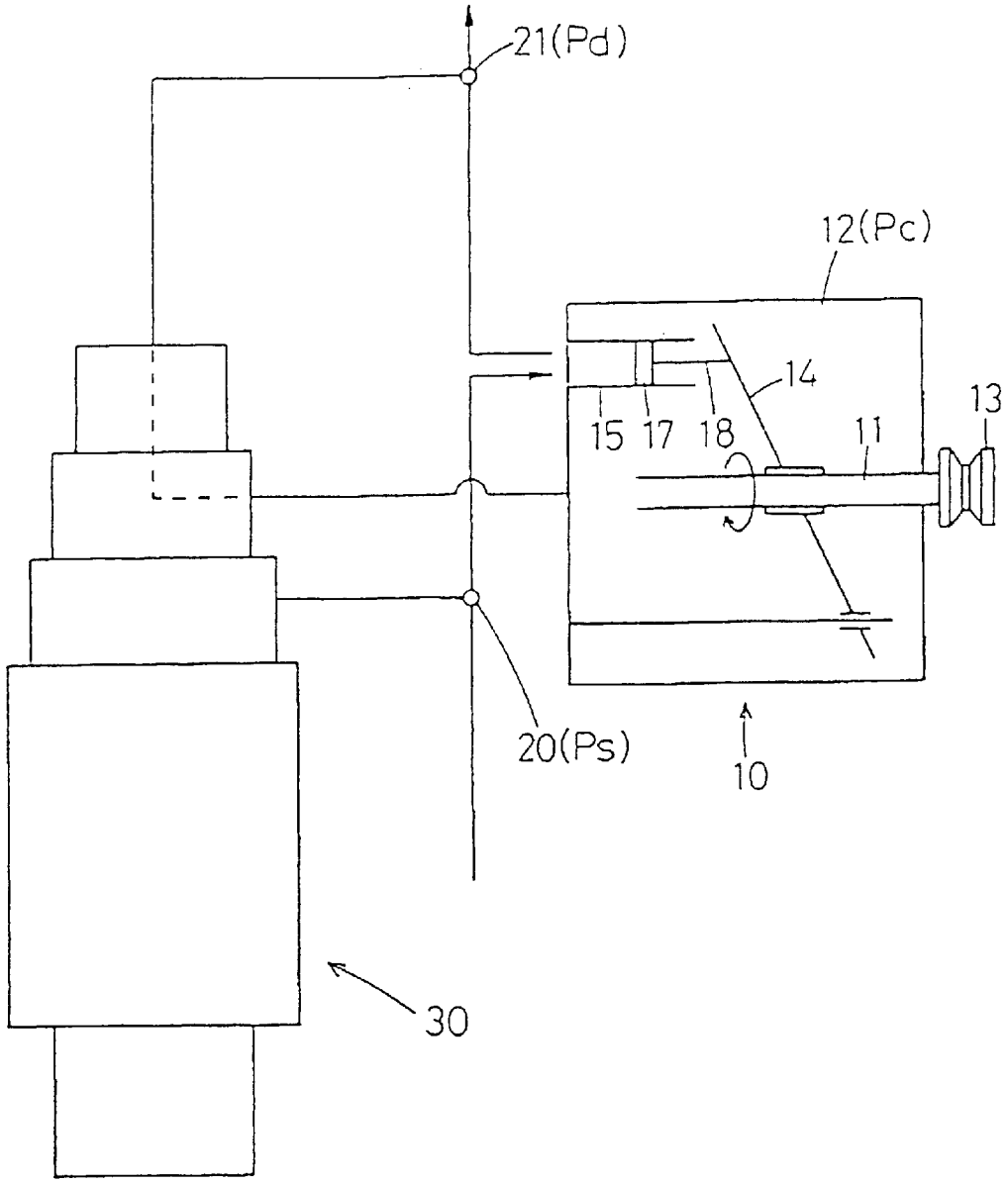

A variable displacement compressor 10 as shown in FIGS. 2 and 3 is used e.g. in a refrigeration cycle of an automobile air conditioner and is co-operating with a displacement control apparatus in the form of a generally indicated solenoid controlled valve 30. Two different displacement states are shown (FIG. 2: state of the minimum displacement; FIG. 3: state of the maximum displacement). An axis 11 of rotation arranged in a airtight crank chamber 12 is driven by driving pulley 13. A swing plate 14 in crank chamber 12 is tilted with respect to axis 11 and swings in accordance with a rotation of axis 11. In a peripheral part of crank chamber 12 a cylinder 15 is arranged receiving piston 17 for free reciprocation. Piston 17 and swing plate 14 are connected by a rod 18.

When swing plate 14 swings, piston 17 is executing reciprocal motions in cylinder 15. Refrigerant is sucked into cylinder 15 from a suction chamber 20 at an upstream side of cylinder 15, is compressed, and thereafter is discharged into a discharge chamber 21 located at a downstream side. Pd represent the pressure in the discharge chamber 21, Pc is the pressure in the crank chamber 12, and Ps is the pressure in the suction chamber 20. The angle of inclination of swing plate 14 in relation to axis 11 varies according to the pressure Pc. The amount of discharge of refrigerant from cylinder 15 (the capacity of the compressor 10) varies with the angle of inclination of swing plate 14. The state of minimum displacement (FIG. 2) occurs if Pc equals Pd. The state of maximum displacement (FIG. 3) occurs when Pc equals Ps.

The respective displacement of compressor 10 is varied by solenoid controlled valve 30 and by automatically controlling pressure Pc in correspondence to a variation of pressure Ps and keeps the compressor 10 in a steady operation state of minimum displacement.

Figure 1:
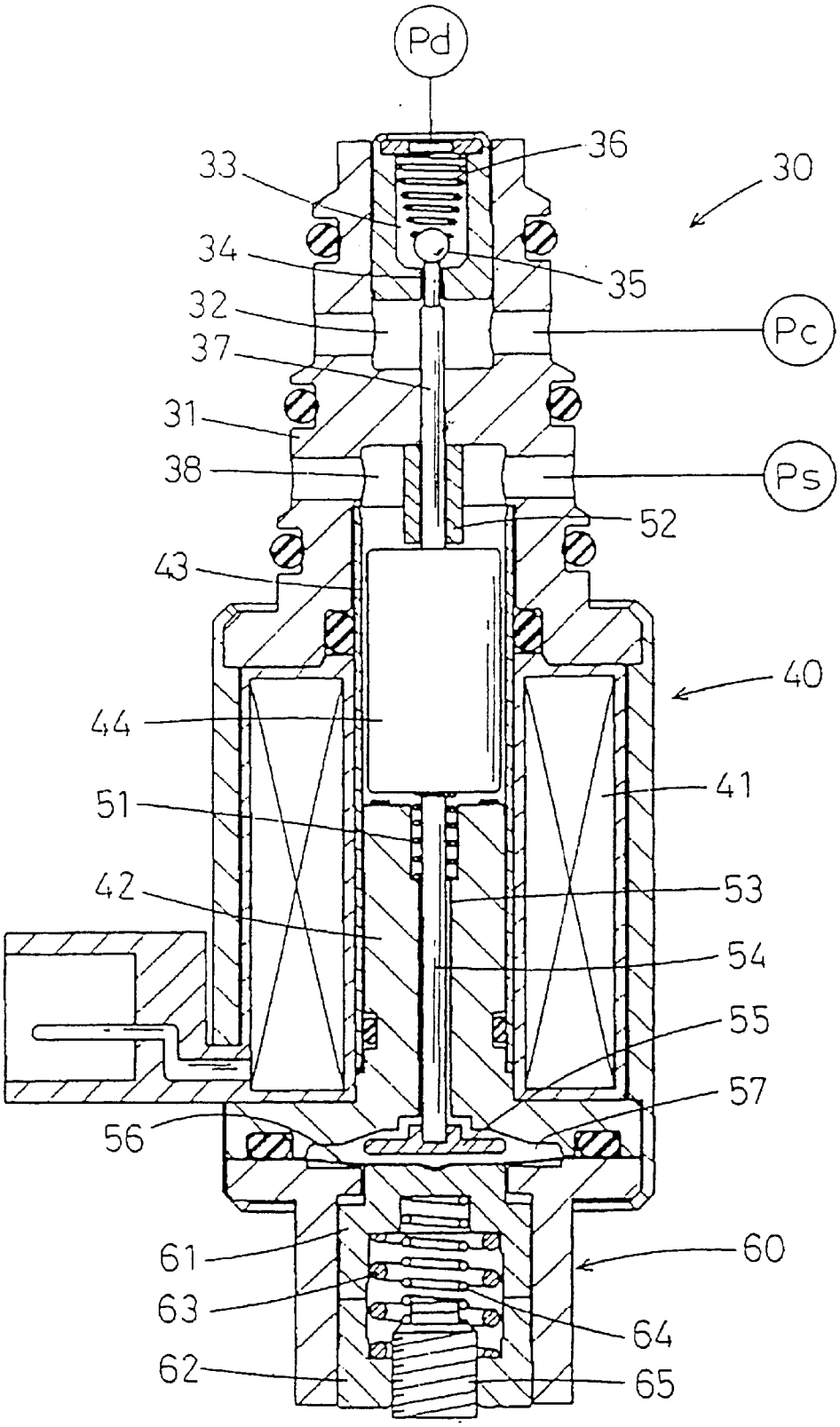
FIGS. 1, 4 and 5 a first embodiment of a solenoid controlled valve, in a longitudinal section, of a displacement control apparatus and in different operation states of a variable displacement compressor, namely in FIG. 1 in a steady operation state of minimum displacement, in FIG. 4 in an operation state of the minimum displacement, and in FIG. 5 at an operation state of maximum displacement.
Figure 4:
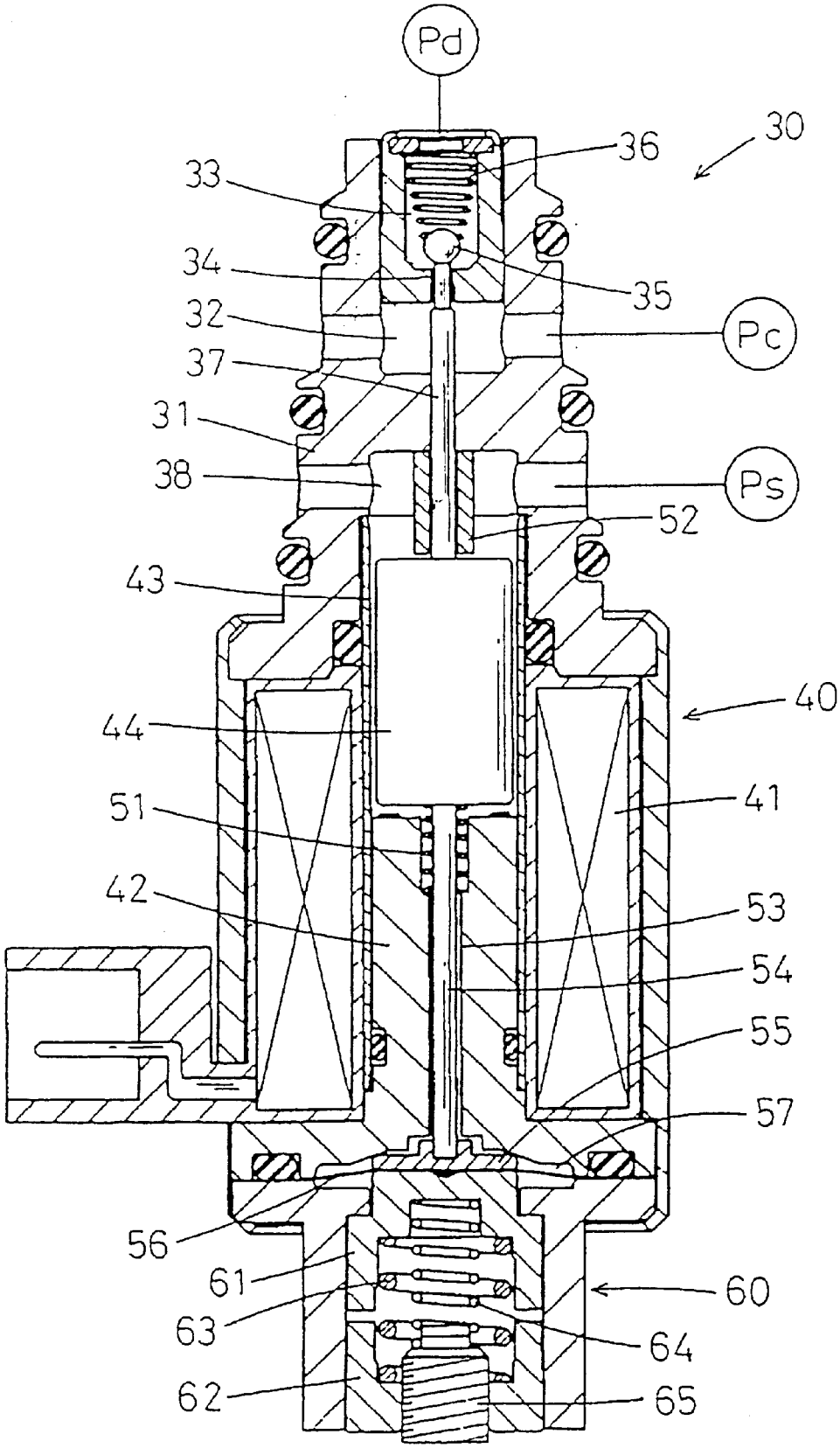
Figure 5:
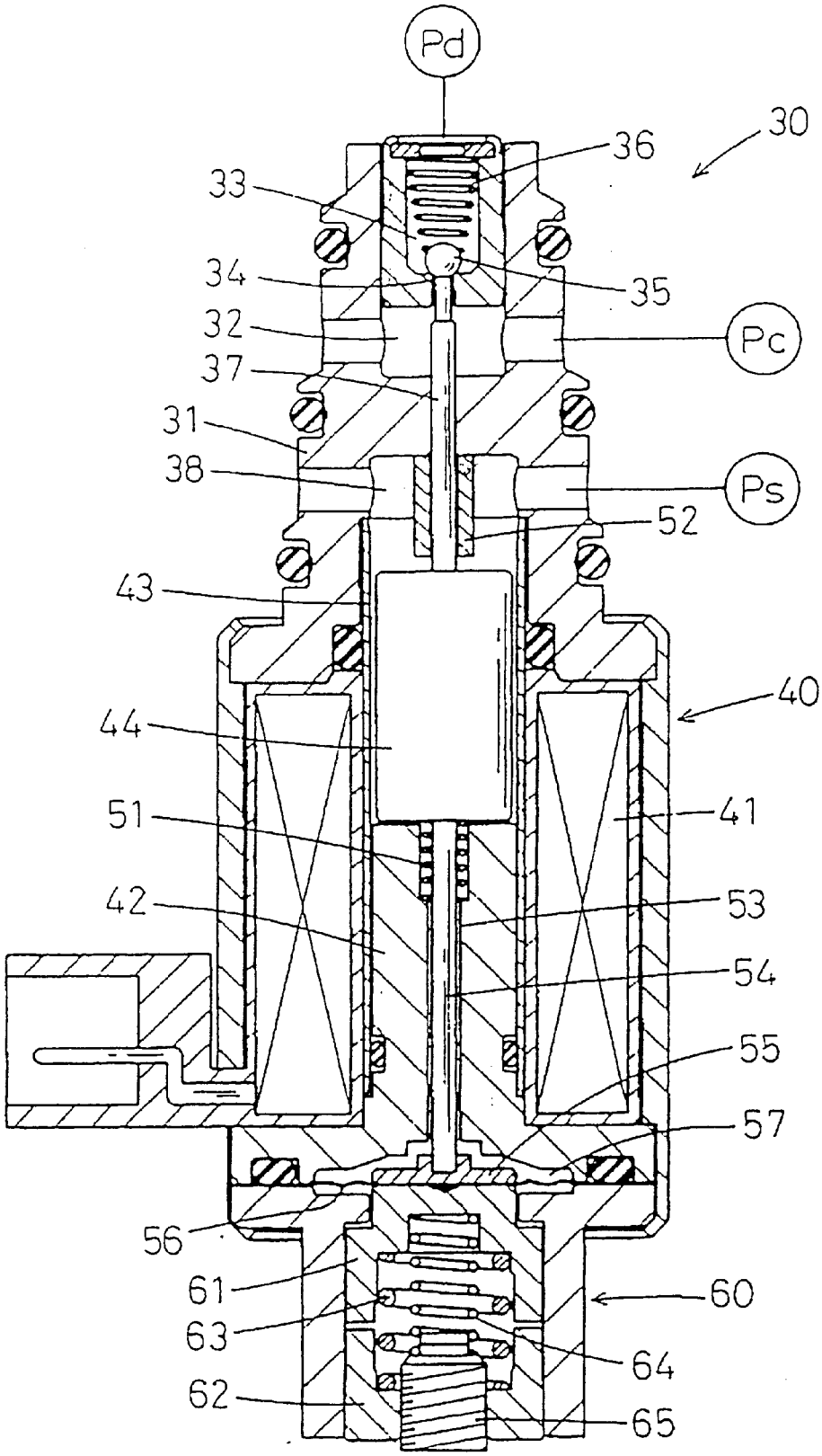

The solenoid controlled valve 30 of FIGS. 1, 4 and 5 includes a body tube 31 inserted into a hole (not shown) of coaxial multi-stepped structure formed within a block e.g. enclosing the compressor 10. In a middle part of body tube 31, a crank chamber connecting part 32 is arranged which is connected to the crank chamber 12 via a side hole. At a protruding edge side of body tube 31 a discharge chamber connecting part 33 is provided connected to the discharge chamber 21 via an opening located at the upper end of body tube 31. Between crank chamber connecting part 32 and discharge chamber connecting part 33 a valve hole 34 in the centre axis of body tube 31 is provided. A spherical valve 35 is provided in discharge chamber connecting part 33 for co-action with the mouth of valve hole 34. In order to prevent jouncing a weak compression coil spring 36 is provided actuating valve 35 towards the mouth of valve hole 34. In case that a valve driving rod 37 loosely inserted into valve hole 34 is forced upwardly against the force of coil spring 36, valve 35 is pushed into discharge chamber connecting part 33 in order to bring valve 35 into an open state.

In the rear half part of body tube 31 a suction chamber connecting part 38 is provided connected to the suction chamber 20. An end side of suction chamber connecting part 38 is situated adjacent to crank chamber connecting part 32. In a partition wall separating crank chamber connecting part 32 from suction chamber connecting part 38 an axial penetrating hole slideably receiving the middle part of driving rod 37 is provided. At a lower flange part of body tube 31 a solenoid 40 is secured. This is the side of body tube 31 where suction chamber connecting part 38 opens (opposite to the side comprising crank chamber connecting part 32). Solenoid 40 comprises an electromagnetic coil 41 and a fixed iron core 42. From suction chamber connecting part 38 to the inside of solenoid 40 a sleeve 43 is extending containing a moveable iron core 44 which is loosely inserted with radial clearance. The lower end of valve driving rod 37 abuts the upper front face of moveable iron core 44.

Between moveable iron core 44 and fixed iron core 42 a compression coil spring 51 for operation is provided. Spring 51 has stronger spring force than coil spring 36. The spring force of spring 51 is transmitted to valve 35 by means of the moveable iron core 44 and valve driving rod 37. If there is no other power than the force of spring 51 acting on moveable iron core 44 and valve driving rod 37, valve 35 is pushed into its open state. A stopper 52 restricts the maximum opening stroke of valve 35. When the electromagnetic coil 41 is energized, the moveable iron core 44 is attracted towards the fixed iron core 42 to produce an urging force for valve 35 in its closing direction.

Moveable iron core 44 co-acts with a connecting rod 54, the upper end of which either is connected to moveable iron core 44 or simply abuts against it. Connecting 54 is loosely inserted into axial penetrating hole 53 of fixed iron core 42. At the lower end of connecting rod 54 a pressure receiving board 55 is fixed. At the outer edge of fixed iron core 42 and facing pressure receiving board 55 a diaphragm 56 is fixed separating the inner part of solenoid 40 containing the pressure Ps from the exterior. The external surface of diaphragm 56 is situated in the atmosphere. Space 57 confined by diaphragm 56 is connected via penetrating hole 53 to suction chamber connecting part 38. Space 57 can be regarded as a part of suction chamber connecting part 38.

To the exterior surface of diaphragm 56 a pressurising mechanism 60 is associated to serving to load diaphragm 56 from the exterior side with a predetermined reference pressure. Between a fixed member 62 and a moveable piston 61 abutting the external surface of diaphragm 56 a spring assembly consisting of compression coil springs 63, 64 is arranged, actuating moveable piston 61 with the necessary force defining said reference pressure. Said urging force of the spring assembly can be finely adjusted by an adjusting screw 65 which in this case only co-acts with inner spring 64.

The inner surface of diaphragm 56 carries suction chamber pressure Ps. The atmospheric pressure and the urging force of springs 63, 64 are carried by the external surface of diaphragm 56. Via diaphragm 56 pressure receiving board 55 at the inner surface of diaphragm 56 is receiving a differential pressure of said applied pressures.

When electromagnetic coil 41 is energized the differential pressure acting on pressure receiving board 55 is transmitted towards valve driving rod 37 via connecting rod 54 and moveable iron core 44 and opening and closing of valve 35 is controlled according to a variation of the pressure Ps such that the displacement of the compressor 10 is controlled. By varying the value of the energising current supplied to electromagnetic coil 41 the value suction chamber pressure Ps is shifted causing changes between an opening and closing state of valve 35.

If electromagnetic coil 41 is de-energized valve 35 is forced into its open state by the force of spring 51 for operation, and the compressor 10 enters into a state of the minimum displacement.

As illustrated in FIG. 1 diaphragm 56 then only retracts from pressure receiving board 55 towards the exterior side, even when the pressure Ps rises and diaphragm 56 is moving towards the exterior side. Said movement is not transmitted to valve 35. Therefore, valve 35 still remains in its open state and the compressor 10 remains in the steady operation state of the minimum displacement.

Figure 6:
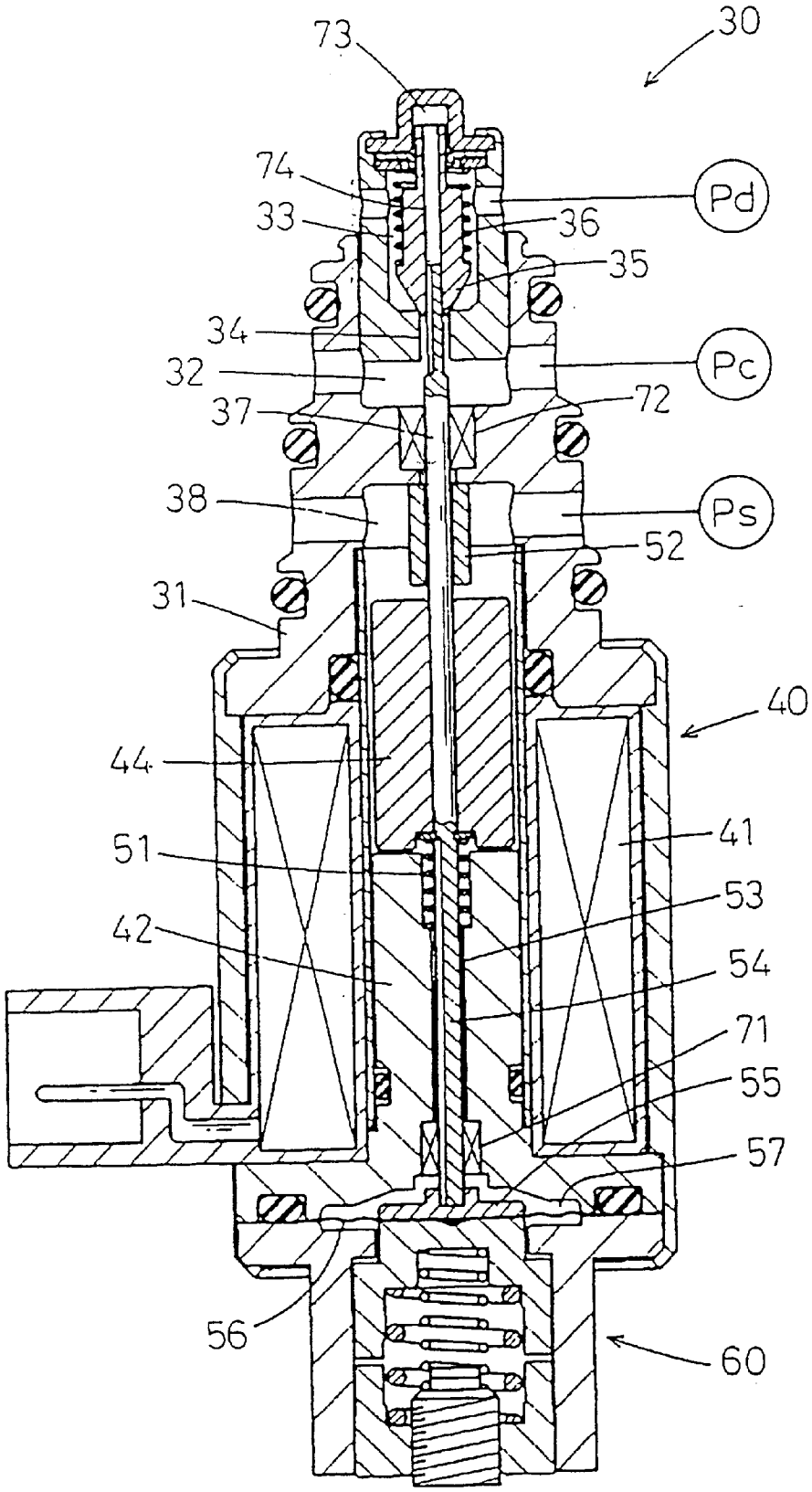
FIGS. 6 and 7 longitudinal sections of two different embodiments of a solenoid controlled valve.

In FIG. 6 valve driving rod 37 and connecting rod 54 are formed as a unitary rod supported by bearings 71, 72 in the regions of both ends of said rod. The provision of bearings 71, 72 leads to small sliding resistance for said rod 37, 54 or said unitary rod, respectively.

In FIG. 6 the cross-sectional form of the portion of the unitary rod representing connecting rod 54 is formed as a polygon (e.g. a regular square or hexagon, etc.) so that a clearance is provided between the inner circular surface of bearing 71 and connecting rod 54 so that there is permanent communication between suction chamber connecting part 38 and space 57 through bearing 71 in fixed iron core 42. Moreover, in order to avoid an influence of the differential pressure between discharge chamber pressure Pd and crank chamber pressure Pc on valve driving rod 37 a space 37 at the rear side of valve 35 which in this case is fixed to the upper end of valve driving rod 37 is connected to crank chamber connecting part 32. For communication purposes a penetrating hole 74 is axially provided in valve 34. An end portion of valve driving rod 37 which is forcibly inserted into penetrating hole 74 has a polygonal cross-section so that there is a clearance between the circular inner wall of penetrating hole 74 and valve driving rod 37.

When electromagnet coil 41 is de-energized, valve 35 is remaining in its open state, regardless of variations of suction chamber pressure Ps so that compressor 10 falls into a steady operation state of the minimum displacement.

Figure 7:
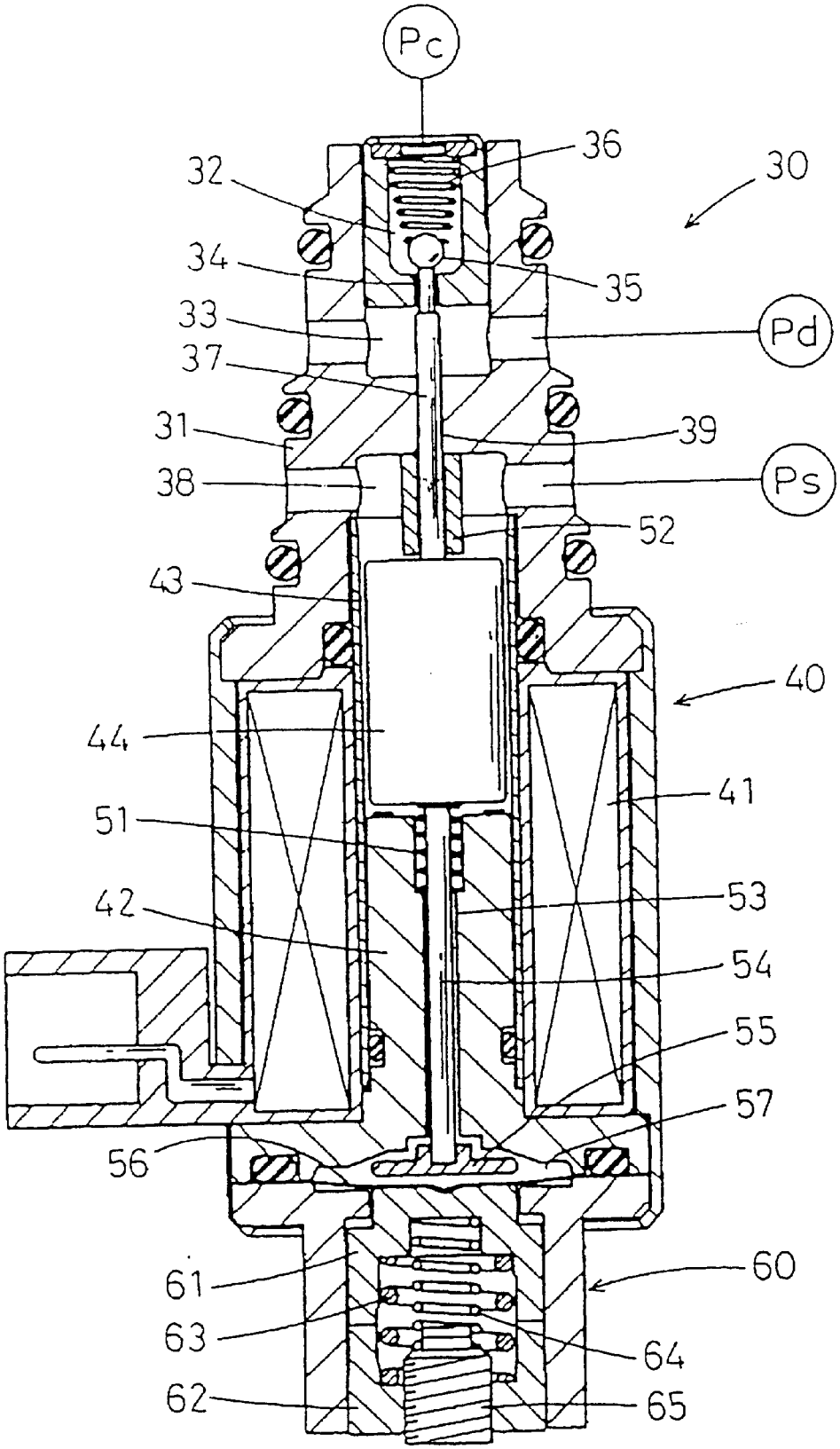

In the embodiment of FIG. 7 in the solenoid controlled valve 30 the connections of the crank chamber connecting part 32 and discharge chamber connecting part 33 are reversed so that the discharge chamber connecting part 32 is situated between the crank chamber connecting part 32 and suction chamber connecting part 38. Moreover, the cross-sectional area of penetrating hole 39 provided between discharge chamber connecting part 33 receiving valve driving rod 37 and suction chamber connecting part 38 is equal to the cross-sectional area of valve hole 34 provided between discharge chamber connecting part 33 and crank chamber connecting part 32. By said measures an influence of discharge chamber pressure Pd on valve driving rod 37 is cancelled in axial direction and the solenoid controlled valve 30 of the displacement control apparatus is executing an accurate control operation.

Figure 9:
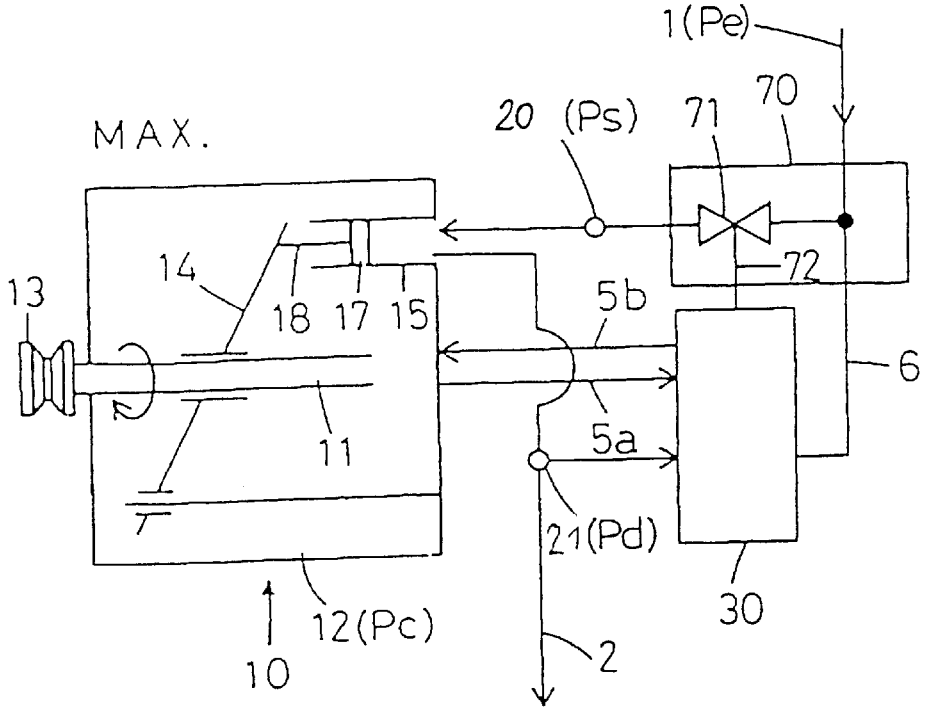
FIGS. 9 and 10 block diagrams of the entirety of a variable displacement compressor equipped with the valve combination of e.g.
Figure 10:
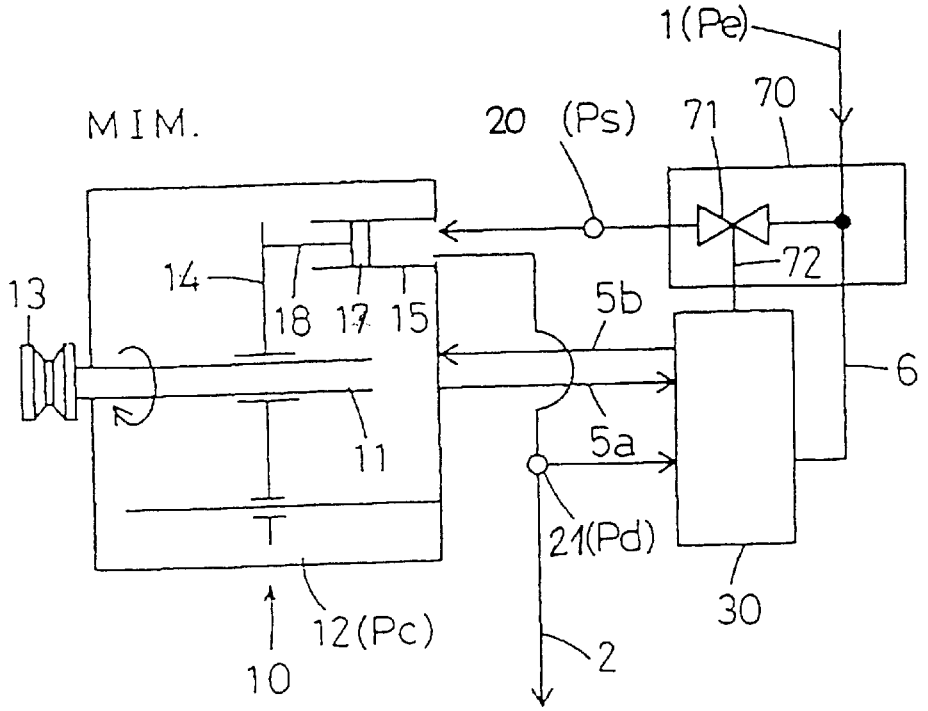

In the schematic illustrations of FIGS. 9 and 10 the solenoid controlled valve 30 constituting the displacement control valve of variable displacement compressor 10 is combined with a suction passage valve 70. Variable displacement compressor 10 is used in a refrigeration cycle of an automobile air conditioner. (FIG. 10 state of minimum displacement; FIG. 9 state of maximum displacement.) In airtight crank chamber 12 (constituting in this embodiment a pressure control chamber) axis 11 of rotation is driven by driving pulley 13. Swing plate 14 in crank chamber 12 is tilted with respect to axis 11 of rotation and is swinging in accordance with a rotation of axis 11. Piston 17 received for reciprocating movement in cylinder 15 in a peripheral part of crank chamber 12 is connected by rod 18 to swing plate 14. With the swinging motion of swing plate 14 piston 17 is executing a reciprocal motion in cylinder 15. Refrigerant is sucked into cylinder 15 from a suction chamber 20 situated on an upstream side of cylinder 15, is compressed and thereafter is discharged to discharge chamber 21 located at a downstream side. Low-pressure refrigerant is supplied to suction chamber 20 from a low-pressure refrigerant pipe conduit 1 located upstream thereof. High-pressure refrigerant is supplied from discharge chamber 21 to a high-pressure refrigerant pipe conduit 2 located downstream thereof. In the housing of the valve combination suction chamber part 3 and discharge chamber part 4 are illustrated for the sake of simplicity, and are connected to suction chamber 20 and discharge chamber 21, respectively. Connecting passages 5 (5*a,* 5*b*) are connected to crank chamber 12. Pe is the pressure in the low-pressure refrigerant pipe conduit 1; Ps is the pressure in the suction chamber 20 and suction part 3; Pd is the pressure in the discharge chamber 21 and discharge chamber part 4; and Pc is the pressure in the crank chamber 12 and connecting passages 5, 5*a,* 5*b,* respectively.

The angle of inclination of swing plate 14 changes according to pressure Pc. The amount of discharge of refrigerant from the cylinder 15 (the capacity of the compressor 10) varies with the angle of inclination of swing plate 14. A state of maximum displacement (FIG. 9) occurs when Pc equals Ps. The state of minimum displacement (i.e. the minimum operation state) occurs (FIG. 8) when pressure Pc increases.

Solenoid controlled valve 30 is controlling the displacement of the compressor 10 by automatically controlling the crank chamber pressure Pc in correspondence to a variation of pressure Pe in the low-pressure refrigerant pipe conduit 1 or to a variation of pressure Ps in the suction chamber 20, respectively. The control level of valve 30 is varied electromagnetically. A connecting pipe 6 extends from low-pressure refrigerant pipe conduit 1 to solenoid controlled valve 30.

In a suction passage between the low-pressure refrigerant pipe conduit 1 and the suction chamber part 3 valve 70 is provided comprising a main valve 71 for opening and closing said suction passage. Valve 70 closes in response to a switching action of the state of solenoid controlled valve 30 in case that valve 30 controls compressor 10 to fall into the minimum operation state.

The valve combination shown in FIGS. 8, 11, 12 and 13 includes solenoid controlled valve 30 keeping the compressor 10 in the steady operation (minimum operation) state of minimum displacement (shown in FIG. 10). First and second crank chamber connecting parts 32*a,* 32*b,* are provided in a middle part of body tube 31 adjacent to another. Discharge chamber connecting part 33 is situated closer to the upper end of body tube 31. Valve hole 34 extending along the axis of body tube 31 interconnects parts 32*a,* 33. In discharge chamber connecting part 33 valve 35 for opening and closing valve hole 34 is provided. In order to prevent jouncing a weak compression coil spring 36 is biasing valve 35 towards the mouth of valve hole 34. Valve hole 34 receives loosely inserted valve driving rod 37. Valve 35 opens when being pushed by the upper end of valve driving rod 37 counter to the spring force of coil spring 36. In that open state valve 35 is abutting against a valve seat 39 arranged at the opposite side in discharge chamber connecting part 33. Valve seat 39 is arranged at an inlet of a main valve driving connecting hole 32. When valve 35 is separated from valve seat 39 part 33 and hole 72 are communicating and pressure Pp in main valve driving connecting hole 72 becomes equal to pressure Pd.

In the lower half part of body tube 31 a low-pressure connecting part 38 connected to low-pressure refrigerant pipe conduit 1 via a side hole is provided. An end side of connecting part 38 is adjacent to crank chamber connecting part 32*b*. Within a partition wall separating second crank chamber connecting part 32*b* from low-pressure connecting part 38 an axially penetrating hole is provided. A valve rod 37*a* integrally formed with valve driving rod 37 is provided to open and close said penetrating hole.

Solenoid 40 is secured to a flange part of body tube 31 in which the low-pressure connecting part 38 is opening (on the opposite side of second crank chamber connecting part 32*b*). Solenoid 40 comprises electromagnetic coil 41, fixed iron core and moveable iron core 44 loosely inserted with clearance in sleeve 43. The lower end of valve driving rod 37 abuts against the front face of moveable iron core 44. Between moveable iron core 44 and fixed iron core 42 operation compression coil spring 51 is arranged, the spring force of which is stronger than the spring force of coil spring 36. The spring force of coil spring 51 is transmitted to valve 35 via the moveable iron core 44 and valve driving rod 37.

When no other force than the force of spring 51 is acting on moveable iron core 44 and valve driving rod 37, valve 35 is pushed into an open state with respect to valve hole 34. If electromagnetic coil 41 is enlarged, electromagnetic force is acting in a direction drawing the moveable iron core towards the fixed iron core 42 (FIG. 11) so that valve 35 closes valve hole 34.

Through fixed iron core 42 a central penetrating hole 53 is extending receiving loosely inserted connecting rod 54 co-acting with its upper end with moveable iron core 44. A pressure receiving board 55 fixed to its other end. At the outer edge of fixed iron core 42 and facing pressure receiving board 55 diaphragm 56 is fixed. The external surface of diaphragm 56 is open to atmosphere. A space 57 above diaphragm 56 is connected to low-pressure connecting part 38 via penetrating hole 53. Space 57 is to be regarded as a pressure chamber and as a part of the low-pressure connecting part 38 which in turn is connected to low pressure refrigerant pipe conduit 1 by connecting pipe 6. To the exterior surface side of diaphragm 56 a pressurising mechanism 60 is associated to, in order to actuate the diaphragm 56 from the exterior side with a reference pressure. Compression coil springs 63, 64 defining a spring assembly are situated between fixed member 62 and moveable piston 61 applying an upwardly directed force against diaphragm 56. For fine adjustment of the spring assembly adjusting screw 65 is provided co-acting with spring 64.

The upper surface of diaphragm 56 detects pressure Pe. The lower or external surface of diaphragm 56 detects atmospheric pressure and the forces of springs 63, 64 as a reference pressure. As a consequence, pressure receiving board 55 is receiving a differential pressure between those applied pressures by means of diaphragm 56. The external surface of the diaphragm 56 may be situated in an airtight space the pressure within which may be used as said reference pressure, instead.

With electromagnetic coil 41 energized the differential pressure acting on pressure receiving board 55 is also acting on valve driving rod 37 via connecting rod 54 and moveable iron core 44. Opening and closing of valve 35 is controlled according to variations of pressure Pe so that the pressure of the crank chamber 12 is controlled as well as the displacement of the compressor 10. A variation of the value of the energising current for electromagnetic coil 41 enables to shift the value of pressure Pe at which the opening and closing states of valve 35 change. Accordingly, the value of pressure Pc corresponding to the value of the refrigerant pressure Pe (i.e. the amount of displacement) also can be shifted.

When electromagnetic coil 41 is de-energized spring 51 opens valve 35 which then connects parts 33 and 32*a*, thereby realising a state (the minimum operation state) in which the compressor 10 maintains its minimum displacement state. At the same time, valve 35 is pushed against valve seat 39 separating hole 72 from part 33. Even if the pressure Pe then rises and the diaphragm is moved towards the exterior side, diaphragm 56 only will retract from pressure receiving board 55 but will not transmit its movement to valve 35. Therefore, valve 35 still remains in its open state and the compressor 10 remains in the steady operation state of minimum displacement.

Figure 11:
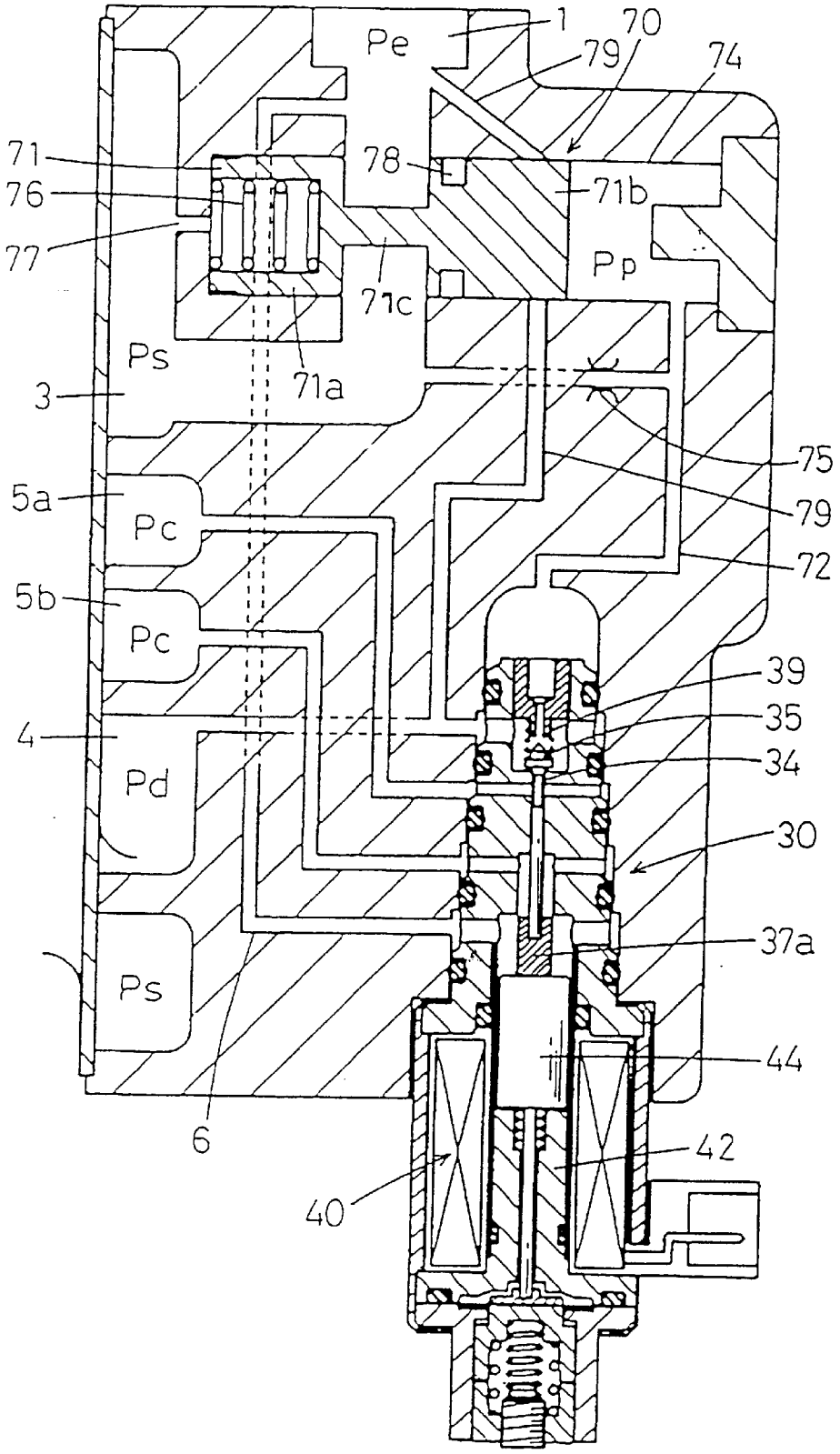
Figure 12:
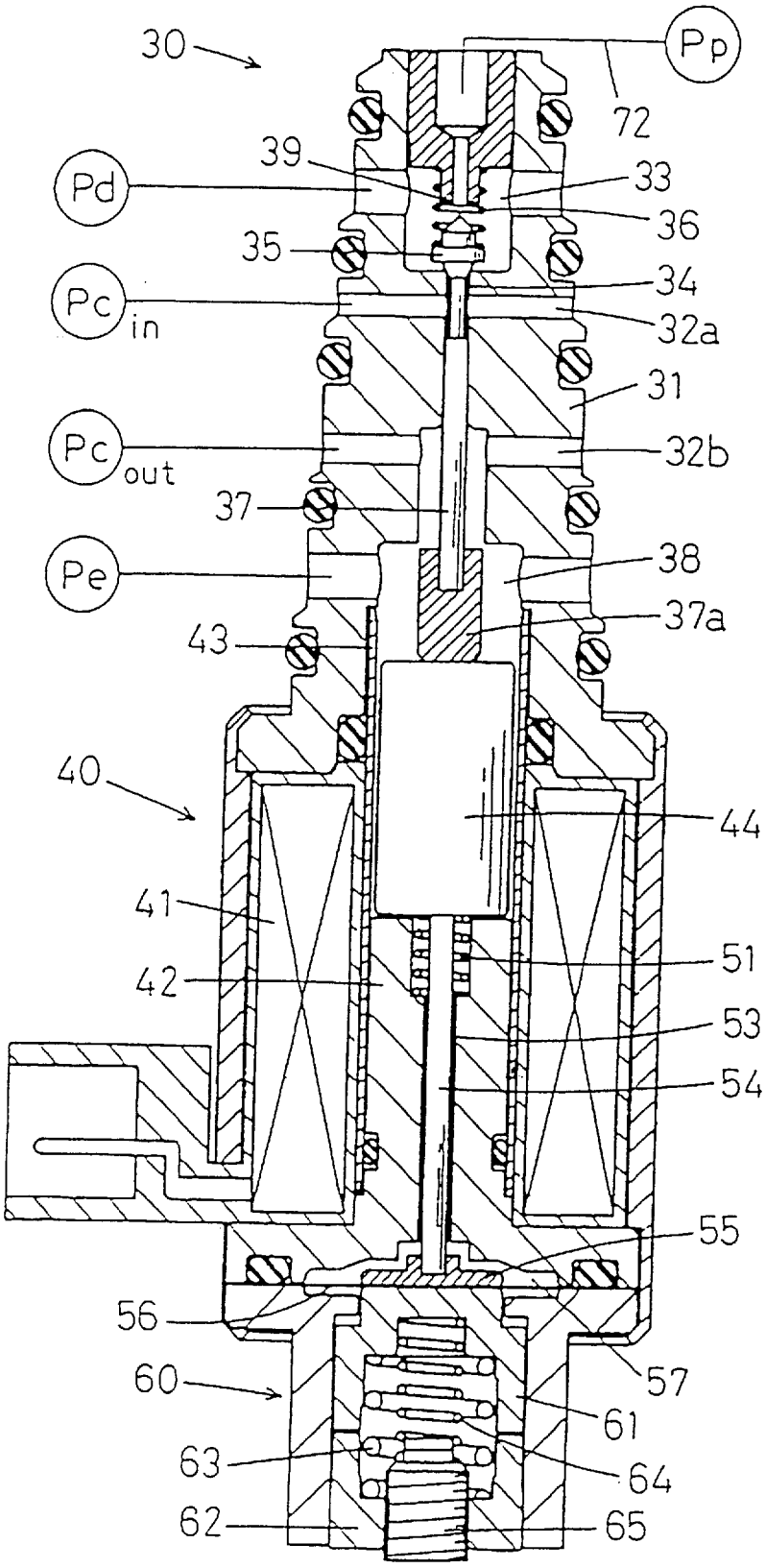
FIG. 12 the solenoid controlled valve of FIGS. 8 and 11 in a longitudinal section and in an enlarged scale, illustrating the state of the maximum displacement at normal operation.
Figure 13:
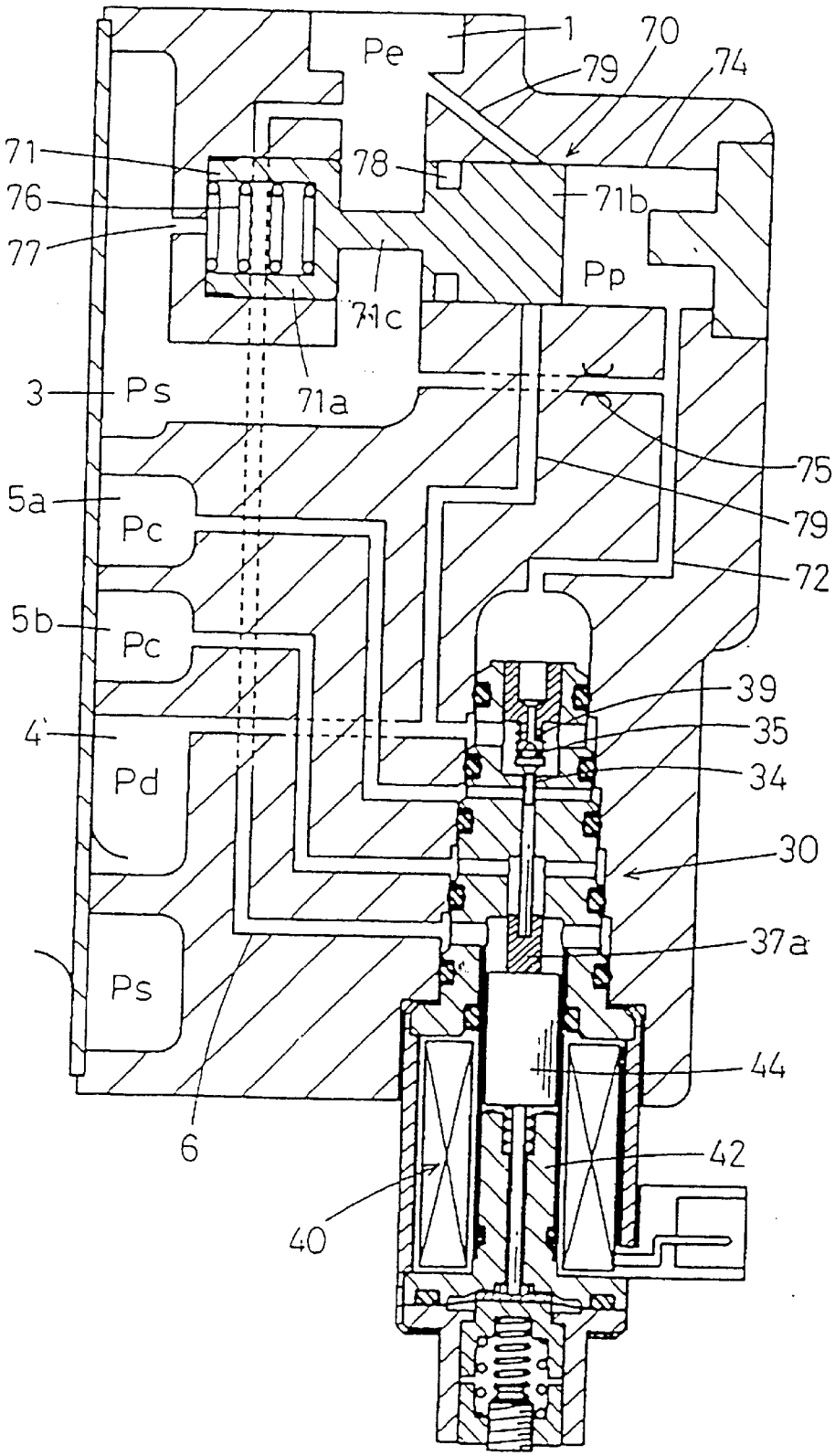
FIG. 13 a longitudinal sectional view of the embodiment of FIGS. 8 and 11 in a state of minimum displacement at normal operation.

According to FIG. 11 main valve 71 of valve 70 is provided midway of a conduit or suction passage connecting low-pressure refrigerant pipe conduit 1 to suction chamber part 3. A thin connecting part 71*c* integrally connects a valve part 71*a* for opening and closing said suction passage and a driving piston body 71*b*. Valve part 71*a* and piston body 71*b* have the same diameter. Pressures applied to the middle part are cancelled or balanced in axial direction. Main valve driving connecting hole 72 leads to a cylinder chamber 74 receiving piston part 71*b*. If valve 35 in is its open state with respect to main valve driving connecting hole 72 pressure Pp within cylinder chamber 74 is approaching pressure Pd (Pp equals Pd). Cylinder chamber 74 communicates with suction chamber part 3 via a thin restriction hole or restrictor 75. When valve 35 enters into its closed state pressure Pp gradually will approach Ps due to restrictor 75 (Pp equals Ps). Main valve 71 is actuated in closing direction by compression coil spring 76 counter to applied pressure in cylinder chamber 74. Pressure Ps permanently is acting on valve part 71*a* in a direction counter to the pressure direction in cylinder chamber 74 via a connecting hole 77. Therefore, main valve 71 operates depending upon differential pressure between the action power Fp resulting from pressure Pp in cylinder chamber 74 and the sum of the urging force Fc of compression coil spring 76 and the action power Fs resulting from pressure Ps. Main valve 71 enters an open state if Fp>Fc+Fs and enters a closed state if Fp<Fc+Fs.

On the peripheral surface of piston part 71*b* a circumferential groove 78 is formed used to open a reflux hole 79 serving to return pressure from discharge chamber part 4 to low-pressure refrigerant pipe conduit 1. Reflux hole 79 is only open when main valve 71 is closed.

When the solenoid 40 or its electromagnetic coil 41, respectively, is energized opening and closing of valve 35 is controlled according to variations of pressure Pe, as mentioned above, and the displacement of the compressor 10 is controlled accordingly. In this state the moveable iron core 44 is drawn towards the fixed iron core 42. Even in the state of the minimum displacement shown in FIG. 13 valve 35 does not close valve seat 39 and pressure Pp in cylinder chamber 74 equals pressure Pd so that valve 70 remains in the open state.

Figure 8:
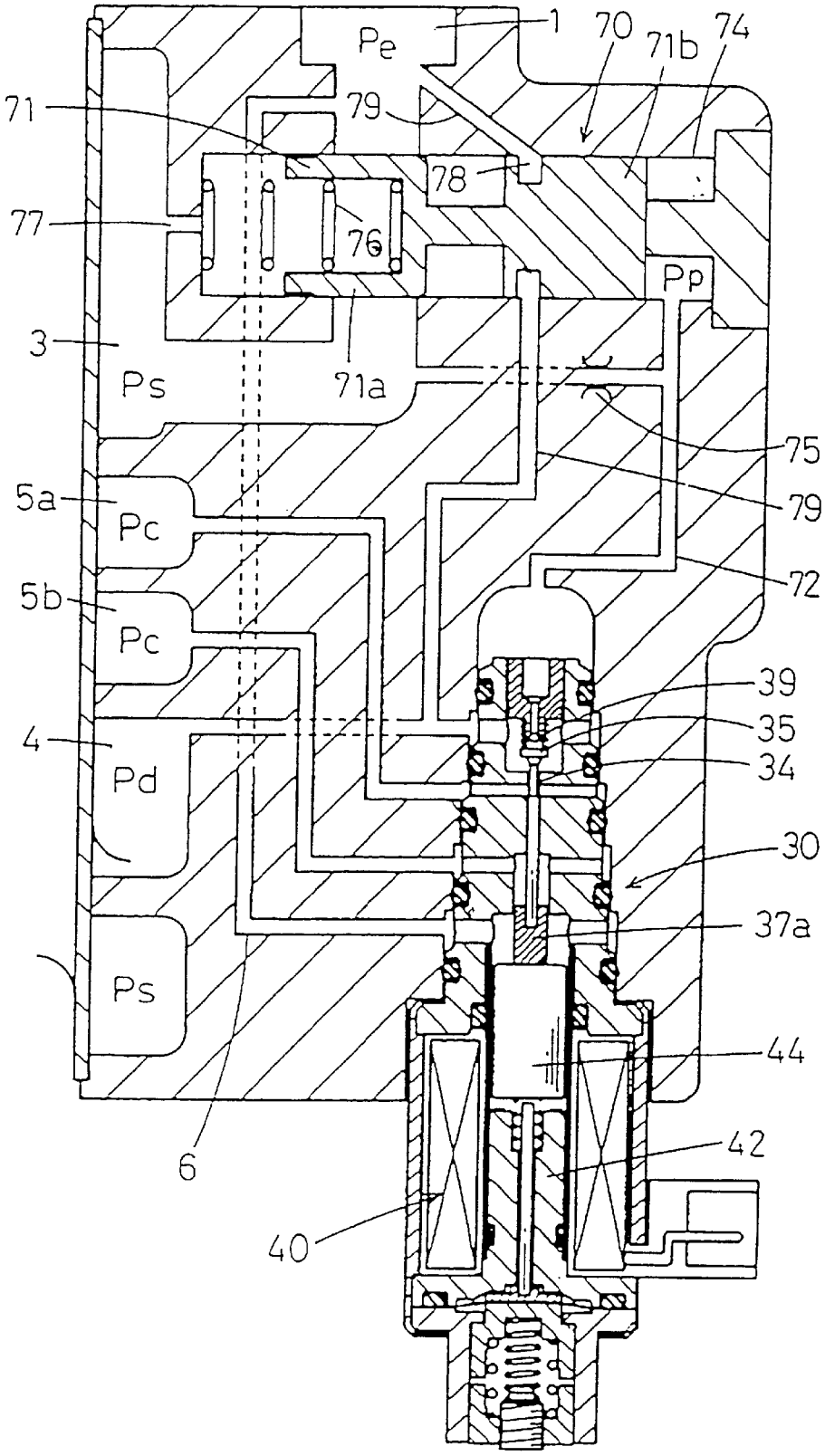
FIGS. 8 and 11 longitudinal sectional views of a further embodiment of a solenoid controlled valve combined with a suction passage open and close valve for a variable displacement compressor, in a minimum operation state and in a state of a maximum displacement at normal operation, respectively.

When the solenoid 40 or its electromagnetic coil 41, respectively, is de-energized and the minimum operation state is realised, moveable iron core 44 is not drawn towards fixed iron core 42. Valve 35 abuts against valve seat 39. Main valve driving connecting hole 37 then is closed. As a result pressure Pp gradually is approaching pressure Ps via restrictor 75. As shown in FIG. 8 compression coil spring 76 is shifting main valve 71 into its closed state closing the suction passage. However, even then a minimum amount of refrigerant should be able to pass through in order to cool and lubricate the compressor 10. So the sealing function of main valve 71 in its closed state intentionally is made imperfectly.

When valve 70 is closed reflux hole 79 is open via circumferential groove 78. The pressure in discharge chamber part 4 is transmitted into low-pressure refrigerant pipe conduit 1 so that the pressure in the latter does not fall too much below a predetermined pressure value. Simultaneously a reflux of the lubricant is realised.

When the solenoid 40 is de-energized connecting rod 54 is separated from moveable iron core 44. Positional changes of diaphragm 56 are not transferred to the moveable iron core 44 and the steady minimum operation is maintained. This is also the case for each of the succeeding embodiments of the invention.

This means that with the solenoid 40 of valve 30 de-energized the variable displacement compressor 10 falls into the minimum operation state of minimum displacement. In response thereto valve 70 closes the suction passage. As a consequence, the fins of an evaporator (not shown) connected to the compressor do not freeze at a time when the load is small e.g. as in winter, i.e. a situation with low cooling demand.

Figure 14:
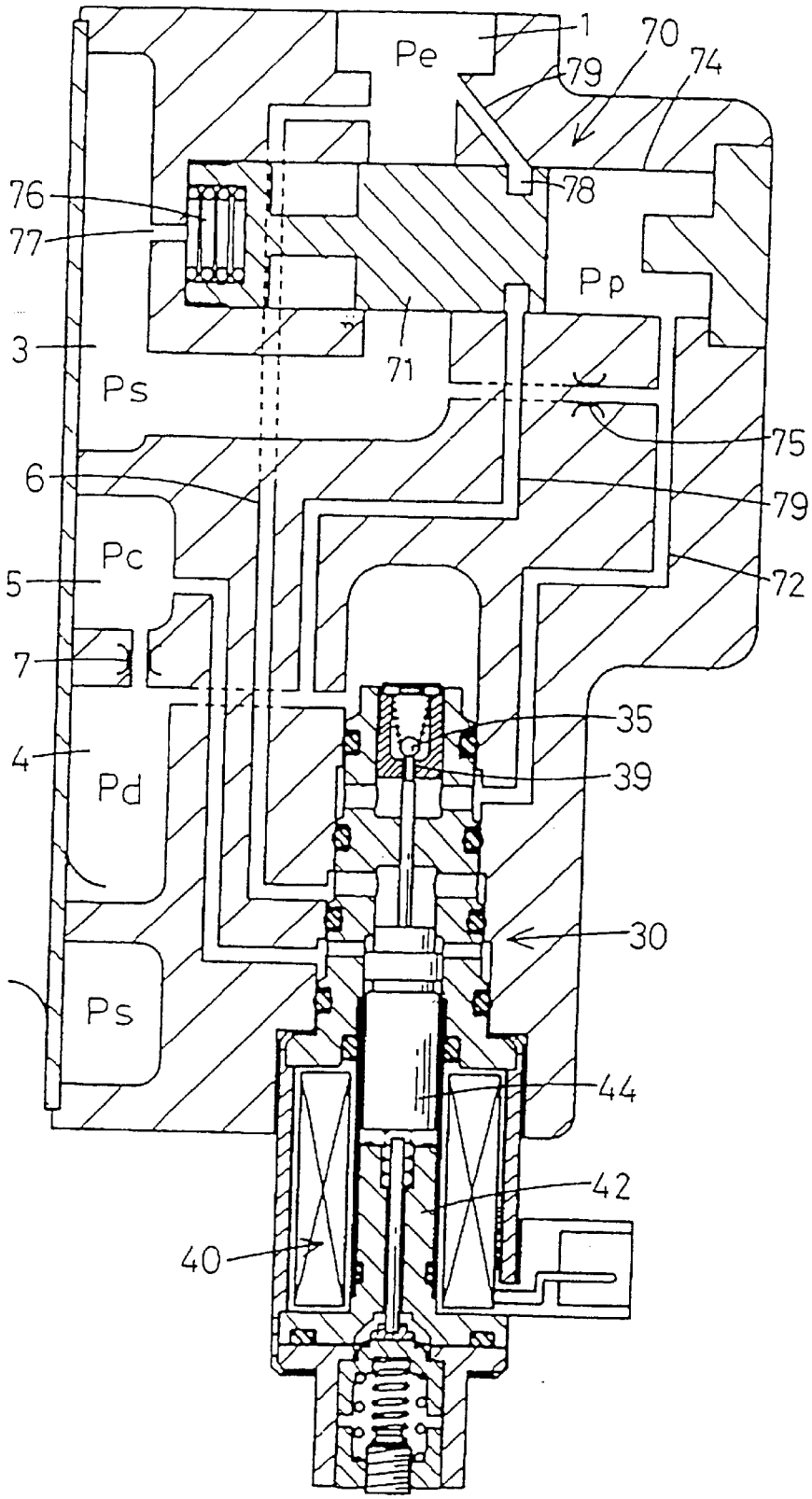
FIG. 14 a longitudinal sectional view of a further embodiment of a valve combination, in the minimum operation state.
Figure 15:
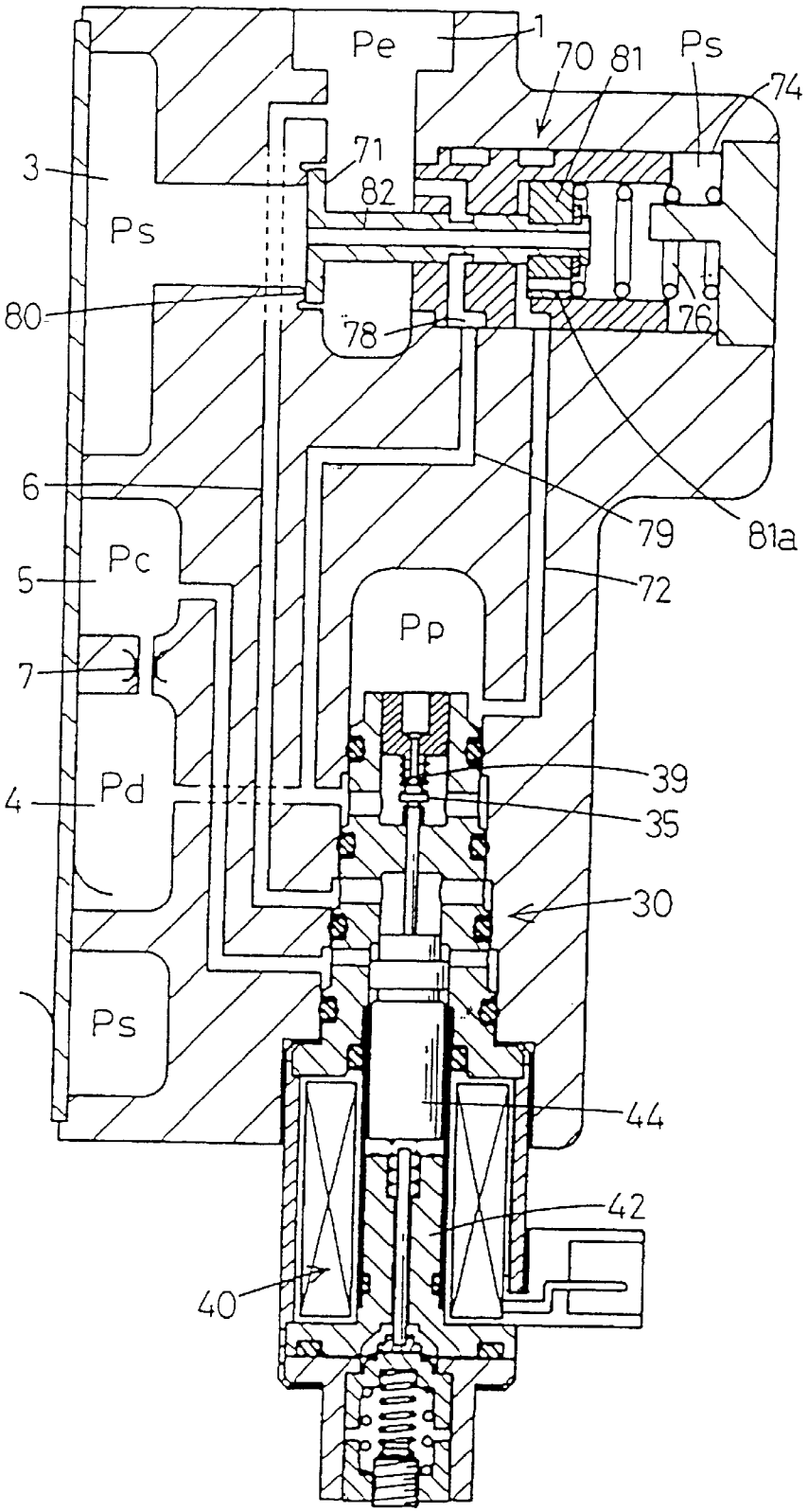
FIG. 15 a longitudinal sectional view of a further embodiment of a valve combination, in the minimum operation state.
Figure 16:
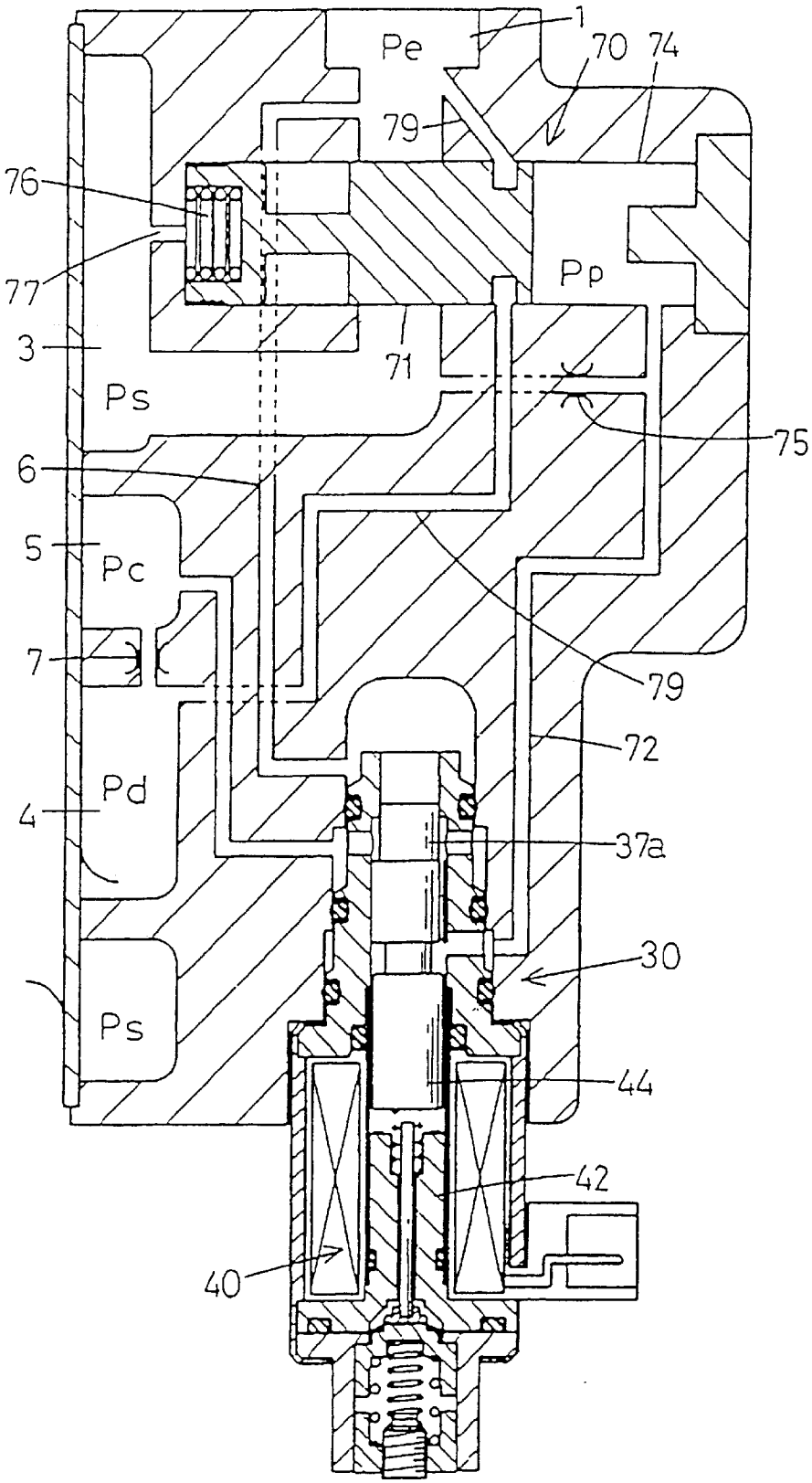
FIG. 16 a longitudinal sectional view of a further embodiment of a valve combination, in a minimum operation state.

Since the embodiments of FIGS. 14 to 16 are similar to the already described only differences will be explained.

In FIG. 14 restriction hole 7 directly connects discharge chamber part 4 to crank chamber 12. The valve seat 39 at the inlet of the main valve driving connecting hole 72 is arranged so that it is located at the former position of valve hole 34 in the preceding embodiment. As a result and different from the preceding embodiment, pressure Pp in cylinder chamber 74 becomes equal to Ps (Pp=Ps) with solenoid 40 energized and becomes equals to Pd (Pp=Pd) in the minimum operation state when the solenoid 40 de-energized. The moving direction of main valve 71 when responding to said pressures is also reversed. In view of this the shape of main valve 71 is so that it has a long portion located in cylinder chamber 74, meaning that the suction passage between the low-pressure refrigerant pipe conduit 1 and suction chamber part 3 is closed when compression coil spring 76 is compressed.

In FIG. 15 (minimum operation state of the variable displacement compressor) restriction hole 7 directly is connecting discharge chamber part 4 to crank chamber 12. Valve seat 39 at the inlet of the main valve driving connecting hole 72 is arranged so as to have a direction opposite to the direction in the preceding embodiment. Moreover, between low-pressure refrigerant pipe conduit 1 and suction chamber part 3 a valve seat 80 is provided. Main valve 71 is designed so as to abut against the valve seat 80 from the side of the low-pressure refrigerant pipe conduit 1 (upstream side). In cylinder chamber 74 (main valve 71 and a pressure carrying board 81 form a valve body) pressure carrying board 81 is connected to the rear end of main valve 71. Compression coil spring 76 is provided in cylinder chamber 74 so as to abut against pressure carrying board 81. Pressure in cylinder chamber 74 always becomes equal to pressure Ps in suction chamber part 3 through connecting hole 82 axially arranged in main valve 71. Main valve driving connecting hole 72 leads into cylinder chamber 74 in a position allowing to connect it to a side of the pressure carrying board 81 opposite to the side at which the board 81 is loaded by pressure Ps. When the solenoid 40 is energized pressure Pp in the space adjacent to the inner side of pressure carrying board 81 becomes equal to Pd (Pp=Pd). Pressure carrying board 81 then is pushed forward until an open valve state is reached. Main valve 71 then clears valve seat 80.

In the minimum operation state with solenoid 40 de-energized pressure Pp at the inner side of pressure carrying board 81 becomes equal to Ps by virtue of restriction hole 81*a* provided in pressure carrying board 81. As a result, main valve 71 is pushed towards valve seat 80 and the suction passage between the low-pressure refrigerant pipe conduit 1 and suction chamber part 3 is closed.

In the embodiment of the valve combination (solenoid controlled valve 30 and valve 70) of FIG. 16, shown at the minimum operation state of the variable displacement compressor, restriction hole 7 directly is connecting discharge chamber part 4 to crank chamber 12. For simplification of the overall structure pressure Pd here is not used to actuate valve 70. In the minimum operation state pressure Pc instead is applied to main valve driving connecting hole 72 leading into cylinder chamber 74 for the actuation of main valve 71. In this case the solenoid controlled valve 30 does not include a valve 35, but instead the function of opening and closing the inlet of the main valve driving connecting hole 72 is carried out by a valve rod 37*a* directly connected to moveable iron core 44. In the minimum operation state pressure Pc is applied to connecting hole 72.

Figure 17:
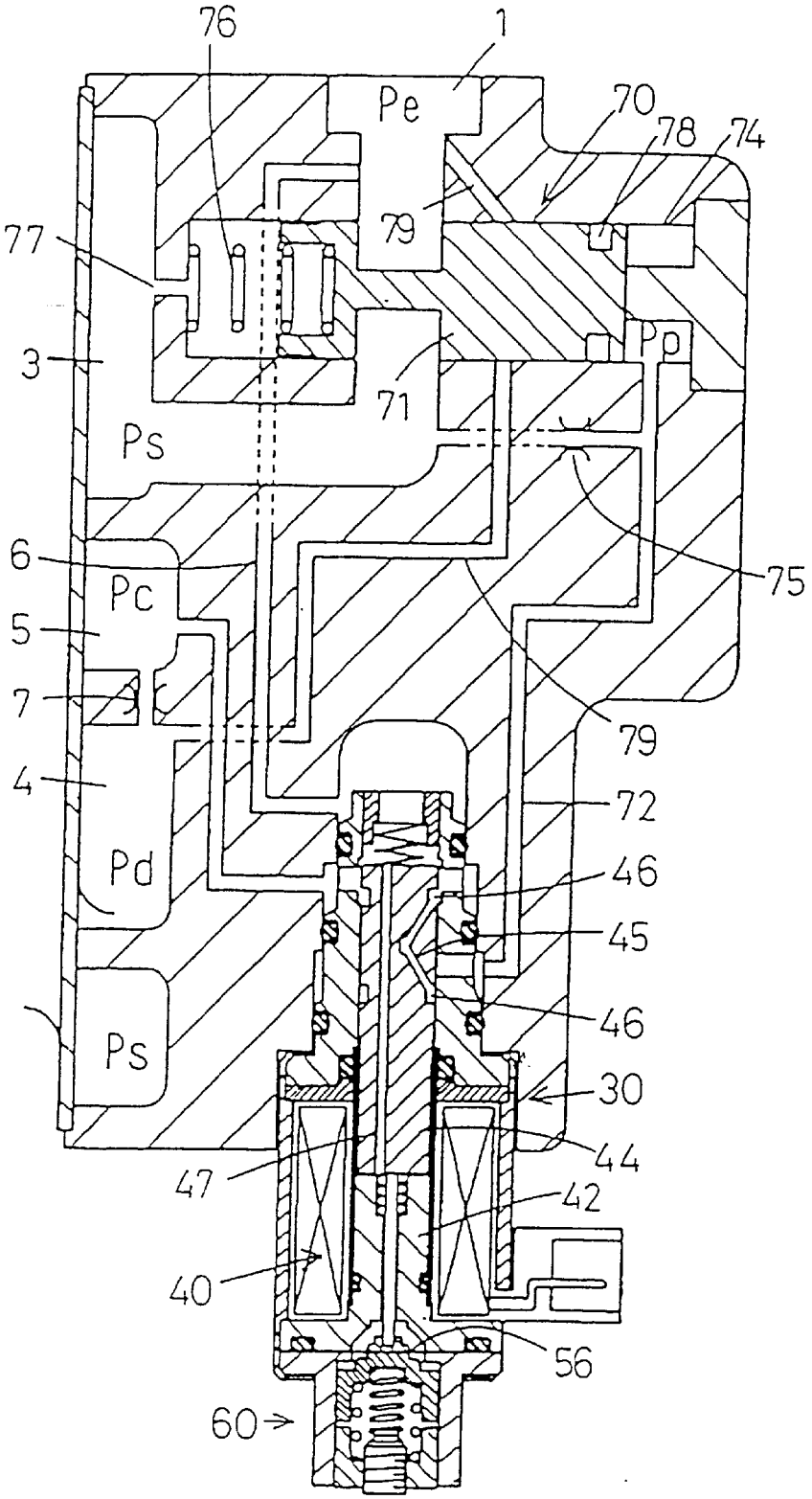
FIGS. 17, 18 and 19 longitudinal sectional views of a further embodiment of a valve combination, in a state of maximum displacement, a state of an intermediate displacement, and in a minimum operation state, respectively.
Figure 18:
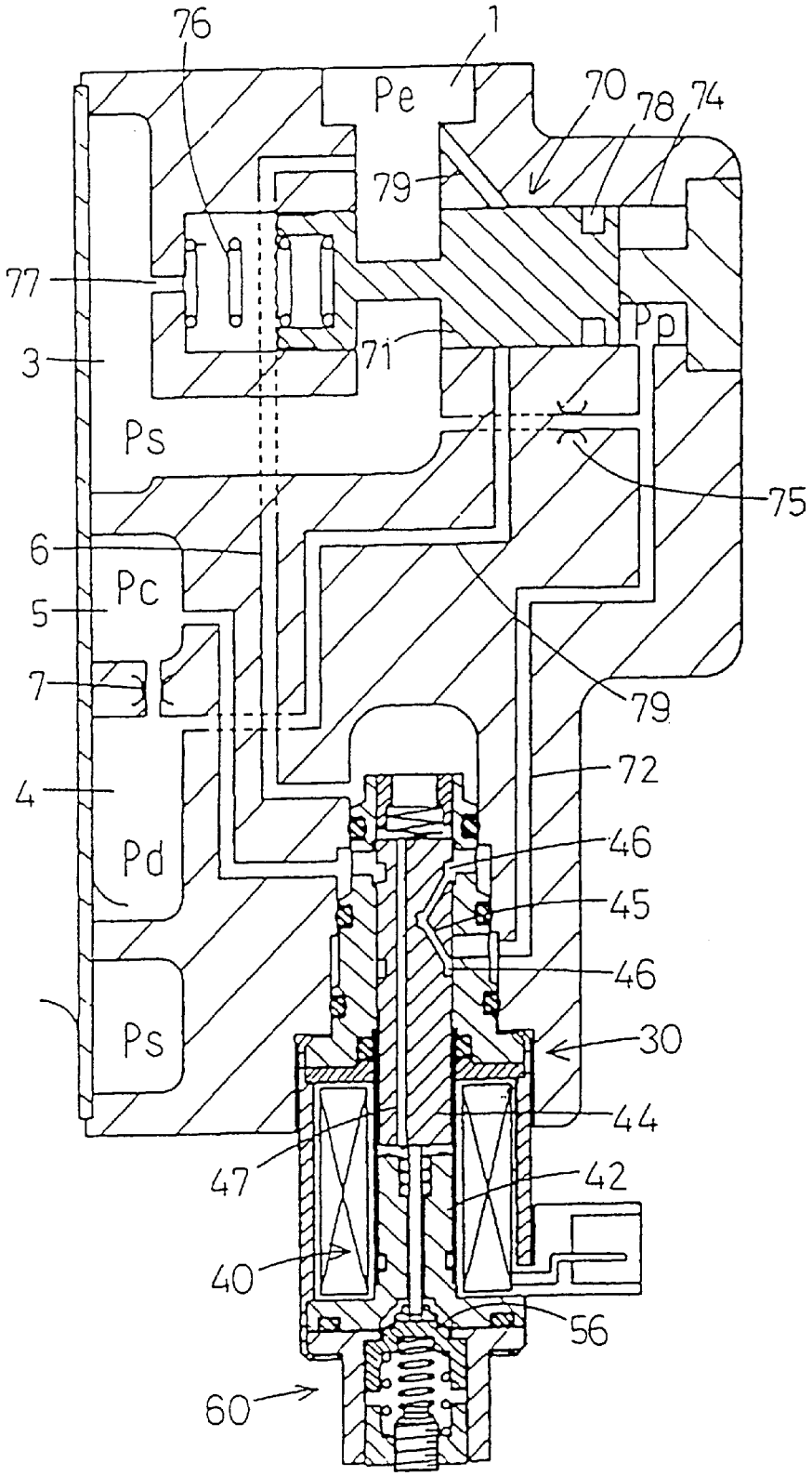
Figure 19:
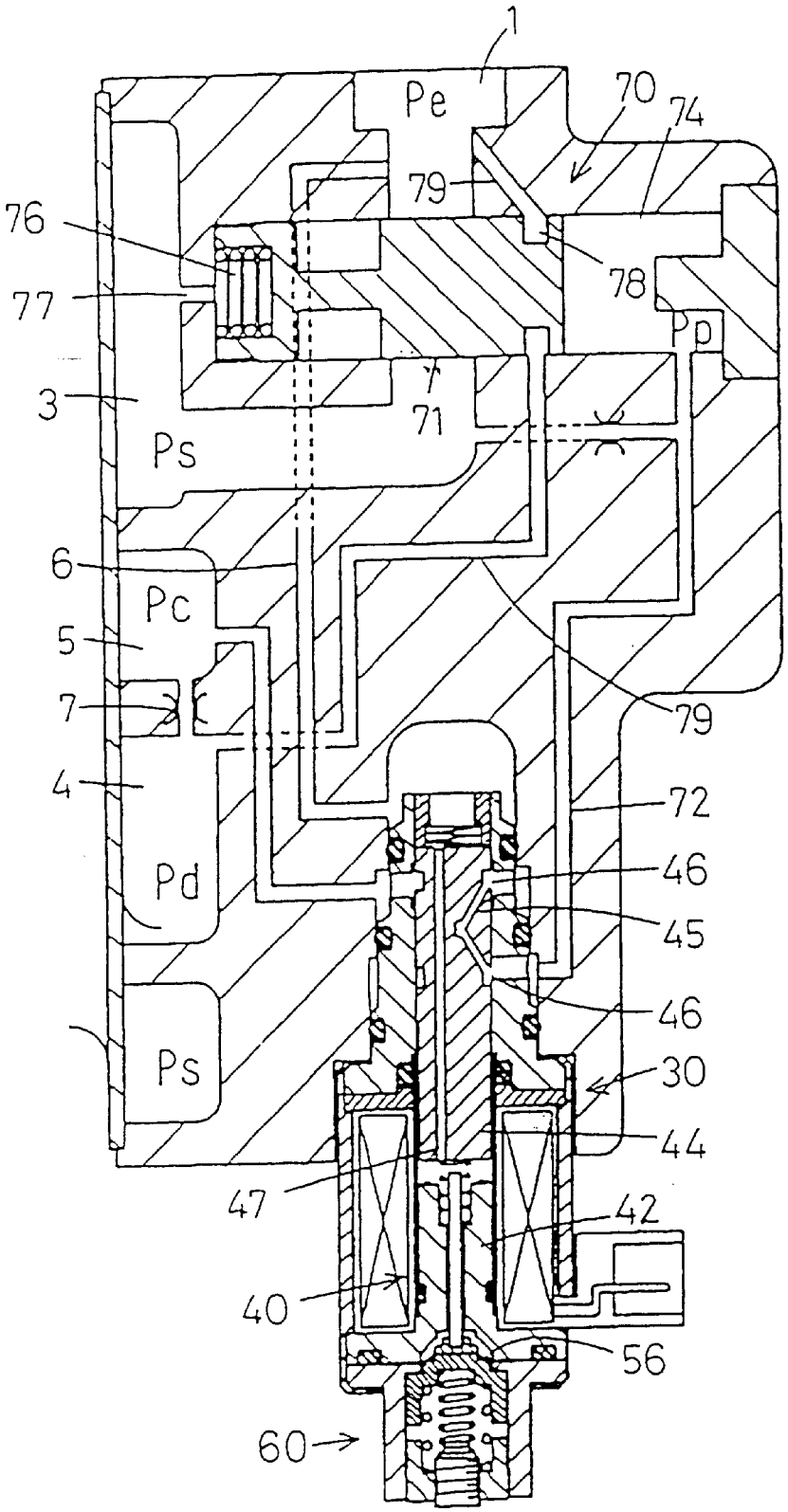
Figure 20:
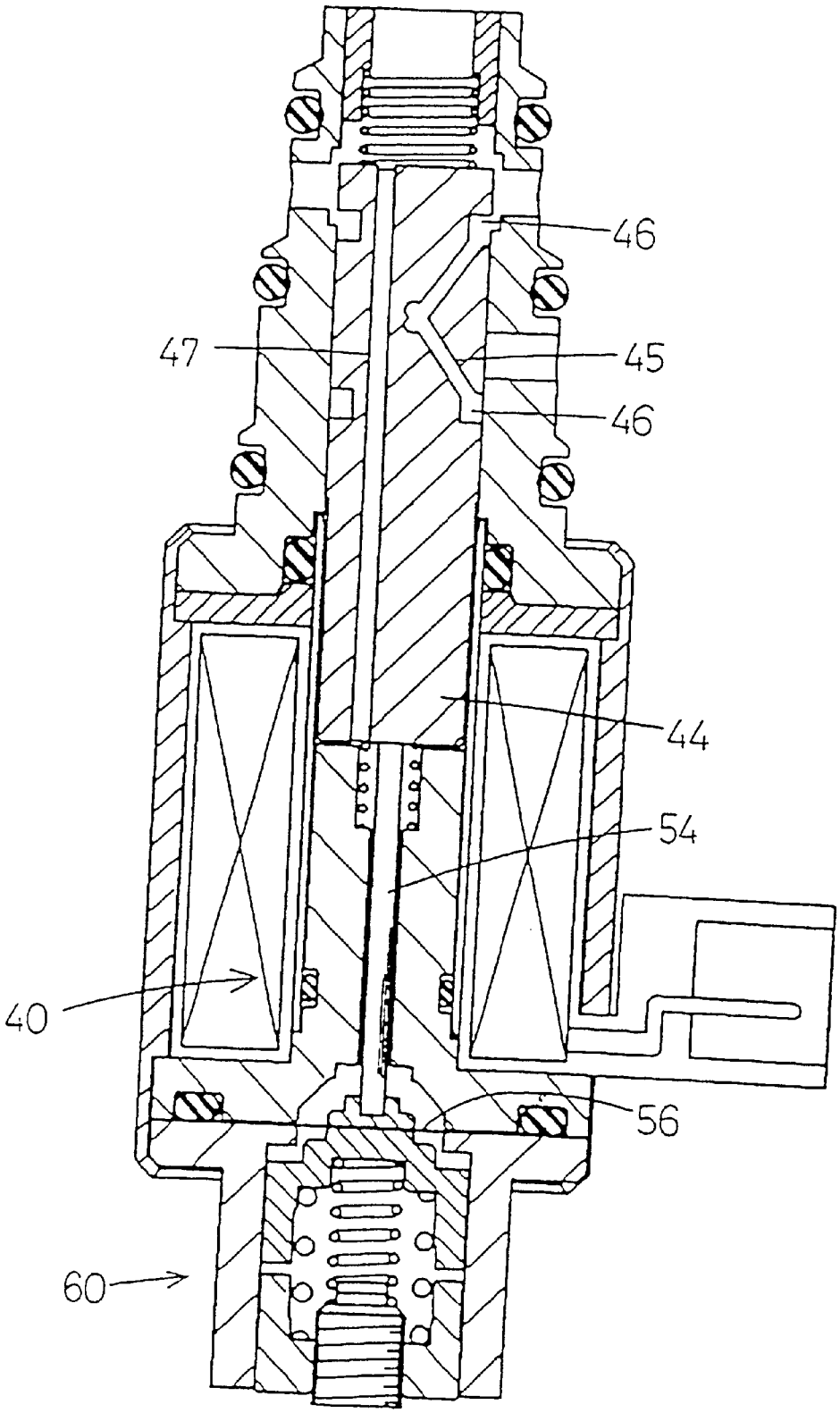
FIGS. 20, 21 and 22 longitudinal sectional views of a solenoid controlled valve as used in the combination of FIGS. 17 to 19, in an enlarged scale and in the state of maximum displacement, the state of an intermediate displacement and at the minimum operation state, respectively.
Figure 21:
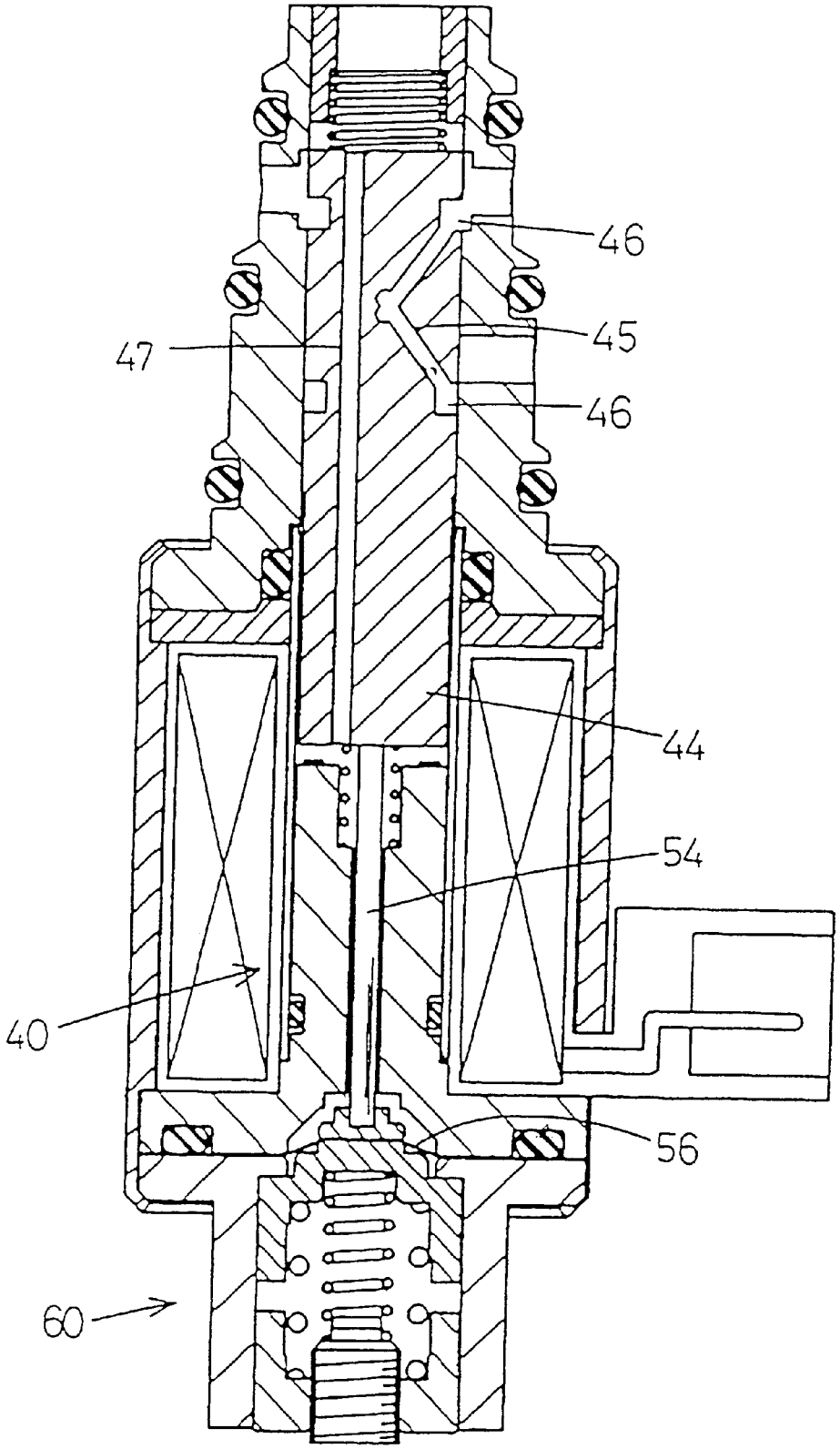
Figure 22:
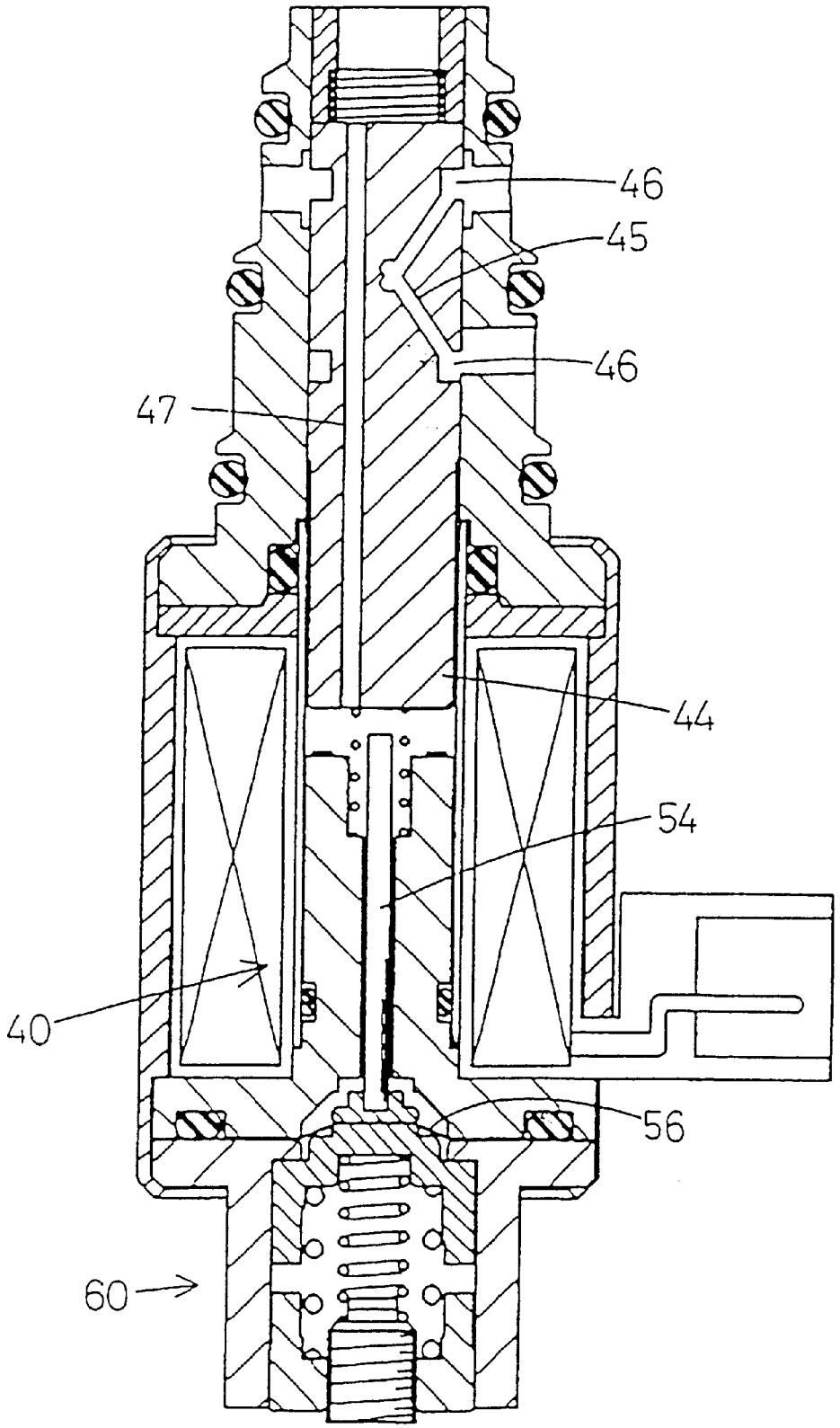

In the embodiments of FIGS. 17 to 19 the solenoid controlled valve 30 is improved, similar as the embodiment of FIGS. 20 to 22. FIGS. 17 and 20 represent the control condition for the state of maximum displacement. FIGS. 18 and 21 represent the control condition for a state of an intermediate displacement. FIGS. 19 and 22 represent the control condition for the minimum operation state in which the state of minimum displacement is maintained.

In the housing of the valve combination of said embodiments restriction hole 7 directly is connecting discharge chamber part 4 to connecting passage 5 connected to crank chamber 12. Moveable iron core 44 has a pair of spaced apart, circumferential grooves 46. Both grooves 46 are connected by a connecting hole 45 formed within moveable iron core 44. Moveable iron core 44 itself fulfils the function of a switch valve for opening or blocking communication between main valve driving connecting hole 72 and connecting passage 5.

At the minimum operation state pressure Pd is not used to actuate valve 70. Instead, pressure Pc via main valve driving connecting hole 72 is used to actuate main valve 71 in cylinder chamber 74. In addition, moveable iron core 44 includes an axially penetrating back-pressure cancelling connecting hole 47, so that the same pressures are acting on both ends of moveable iron core 44 and pressure Pe always is acting on the inner surface of diaphragm 56. By said measure a cancellation of back-pressure in the entire pipe system is achieved and the valve permanently is operating normally.

Figure 23:
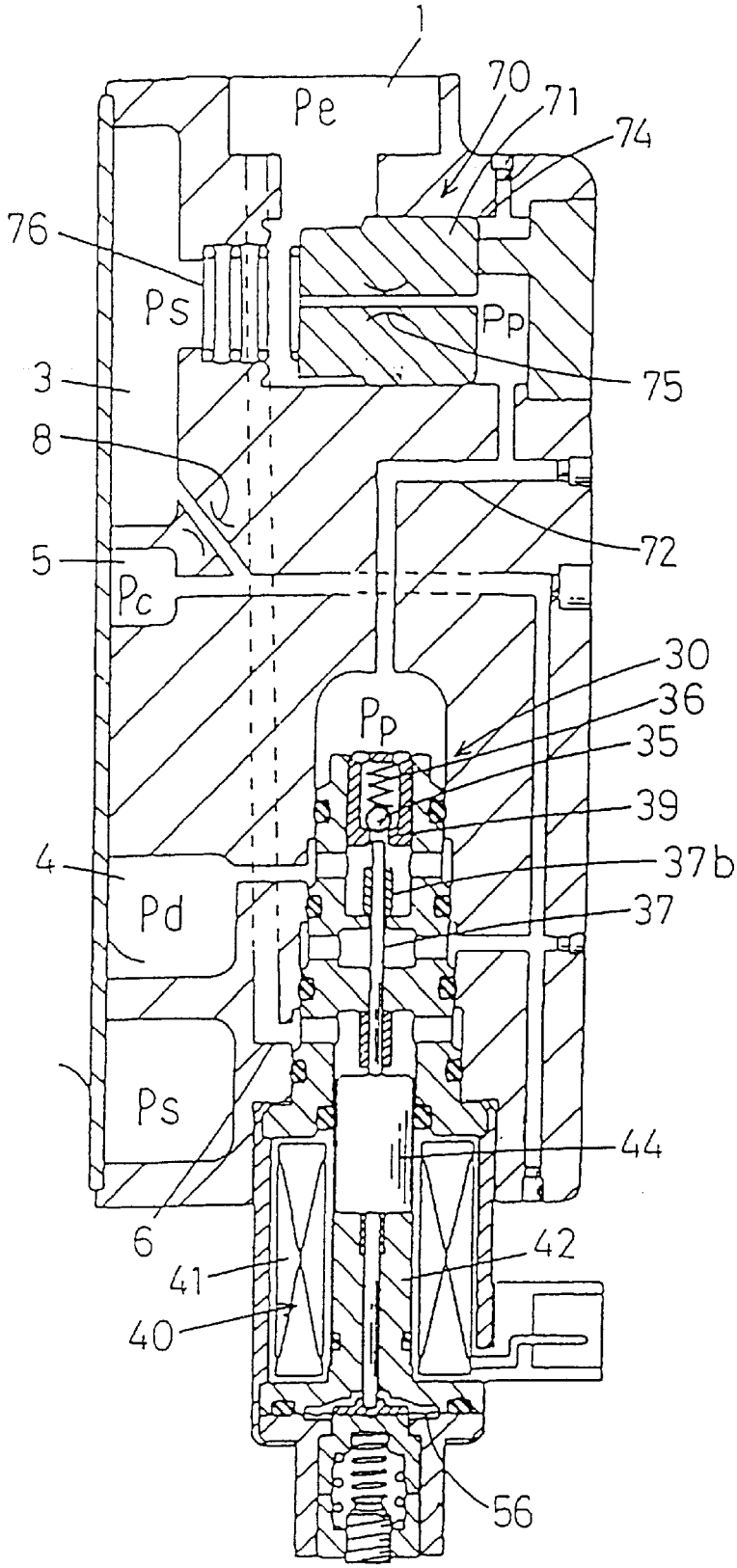
FIGS. 23, 24 and 25 longitudinal sectional views of a further embodiment of a valve combination, in the state of maximum displacement, a state of an intermediate displacement and in the minimum operation state, respectively.
Figure 24:
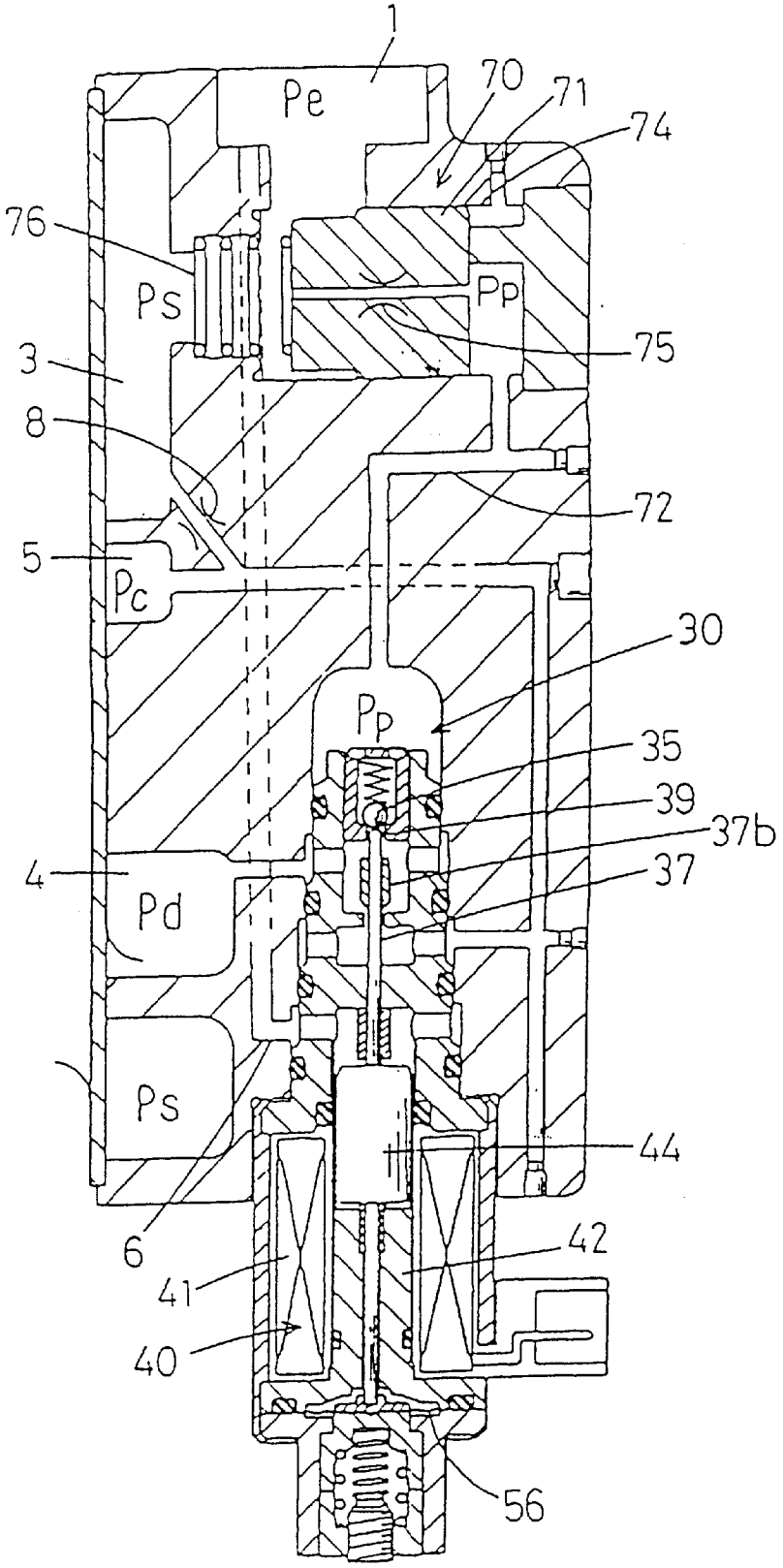
Figure 25:
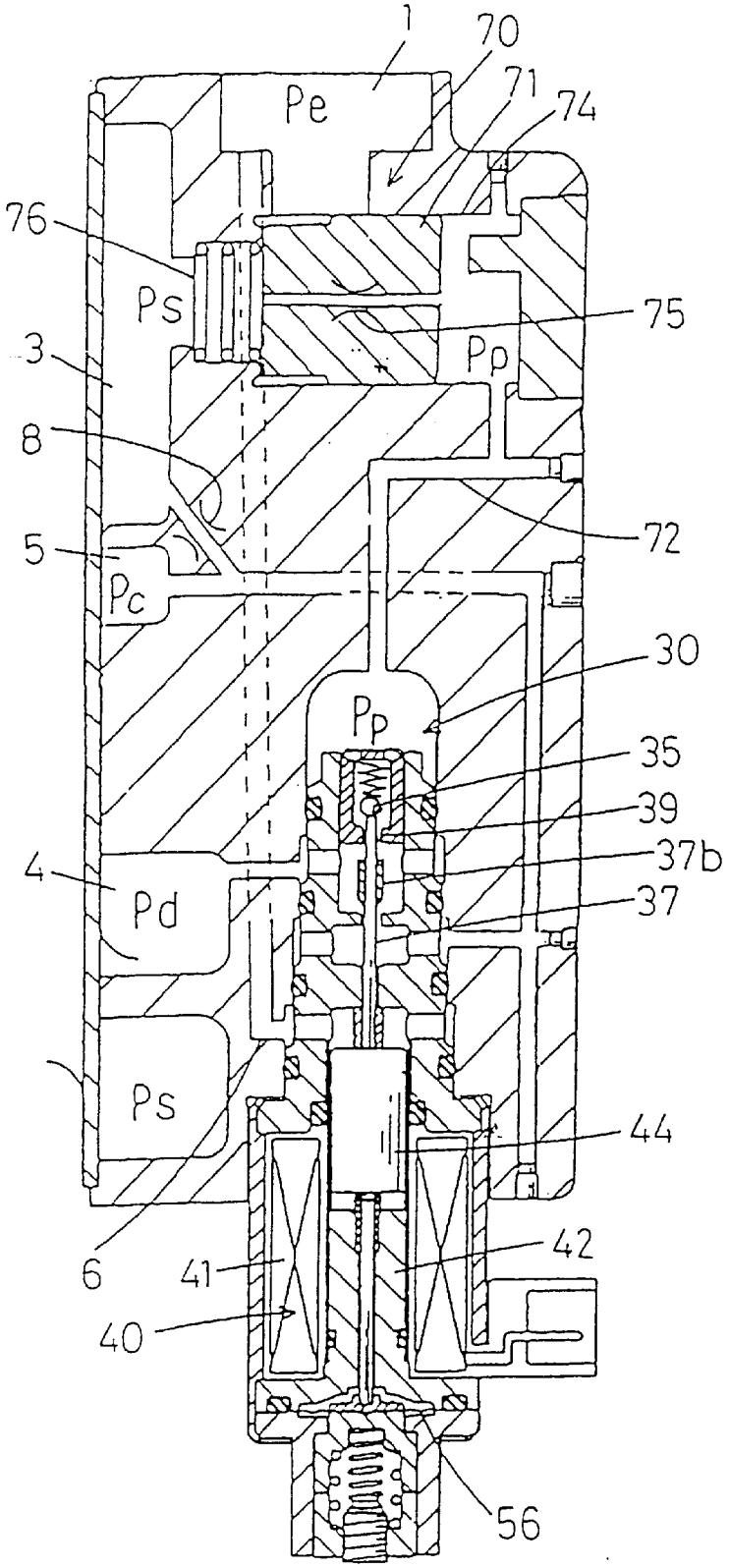

In embodiment of the valve combination of FIGS. 23 through 25 the structure has been improved further. FIG. 23 is representing the control condition in the state of the maximum displacement. FIG. 24 is representing the control condition for the state of intermediate displacement. FIG. 25 is representing the control condition where the state of the minimum displacement is maintained. The main valve 71 is closing the suction passage between the low-pressure refrigerant pipe conduit 1 and suction chamber part 3 when pressure Pp in cylinder chamber 74 is high. Main valve 71 is retracted to open said suction passage when pressure Pp is dropping. Within main valve 71*a* restriction hole 75 is formed connecting the inner side of cylinder chamber 74 to suction chamber part 3. Even if the pressure in cylinder chamber 74 is high, said pressure gradually will drop in order to open valve 70 if cylinder chamber 74 is not connected to the high-pressure portion via line 72. Moreover, the reflux hole 79 as used in preceding embodiments is not provided. Valve 35 of solenoid controlled valve 30 driven by solenoid 40 includes a ball-shaped closure member and functions to open and close a passage between discharge chamber part 4 and main valve driving connecting hole 72. Valve 35 is actuated by the upper end of valve driving rod 37. A middle part of valve driving rod 37 is formed as a valve part 37*b* for opening and closing a passage between connecting passage 5 (to crank chamber 12) and discharge chamber part 4. Pressure Pe in low-pressure refrigerant pipe conduit 1 is applied to the inner surface of diaphragm 56 via connecting tube 6, e.g. formed inside the housing. Restriction hole 8 directly interconnects connecting passage 5 and suction chamber part 3. When solenoid 40 (its electromagnetic coil 41) is energized valve 35 is closed. Pressure Pp in cylinder chamber 74 is equal to the suction pressure Ps (Pp=Ps). As a consequence, valve 70 is maintained in an open state. A variation of the displacement control from the range of a state of the maximum displacement (FIG. 23) to the state of an intermediate displacement (FIG. 24) is executed in correspondence with the variation of pressure Pe applied to diaphragm 56. The control level can be shifted arbitrarily by the value of the energising current.

In the state of maximum displacement (FIG. 23) valve part 37*b* is in a closed state in relation to the connection between discharge chamber part 4 and connecting part 5. Via restriction hole 8 pressure Pc in connecting passage 5 becomes equal to suction pressure Ps (Pc=Ps). In a control condition representing the state of an intermediate displacement (FIG. 24) valve part 37*b* is raised and does not close the connection hole. As a consequence, pressure Pc in connecting passage 5 will rise.

When solenoid 40 is de-energized valve 37*b* is opened wide (FIG. 25). Connecting passage 5 is fully communicating with discharge chamber 4. Pressure Pc becomes equal to pressure Pd (Pc=Pd), so that the variable displacement compressor 10 is brought into the state of the minimum displacement.

Due to the movement of valve 35 into an open state pressure Pp in cylinder chamber 74 becomes equal to pressure Pd (Pp=Pd). Valve 70 is brought into its closed state so that the minimum operation state is achieved.

Figure 26:
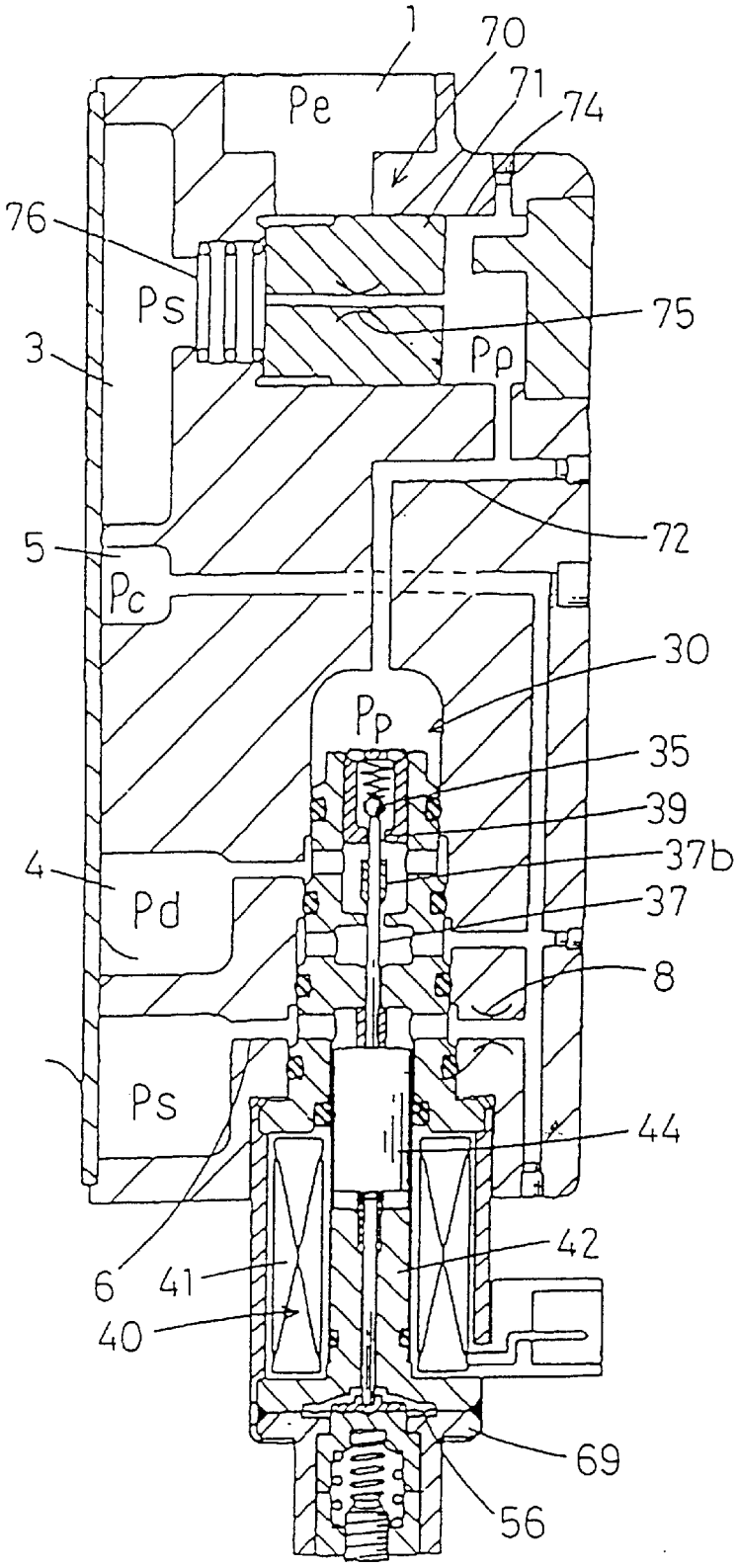
FIG. 26 a longitudinal sectional view of a further embodiment of a valve combination, in the state of minimum operation.

In the embodiment of the valve combination shown in FIG. 26 suction pressure Ps is applied to the inner surface of diaphragm 56 via a connecting passage 106. By said measure the entire structure is simplified. Its function similar to the function of the preceding embodiment. The peripheral edge of diaphragm 56 is placed between fixed iron core 42 and a flange 69 of the pressurising mechanism. The outer edge of the diaphragm 56 is fixed from the outside by laser welding, etc. Therefore, the diaphragm 56 can be made of metal. This can be realised as well in the other embodiments.

Figure 27:
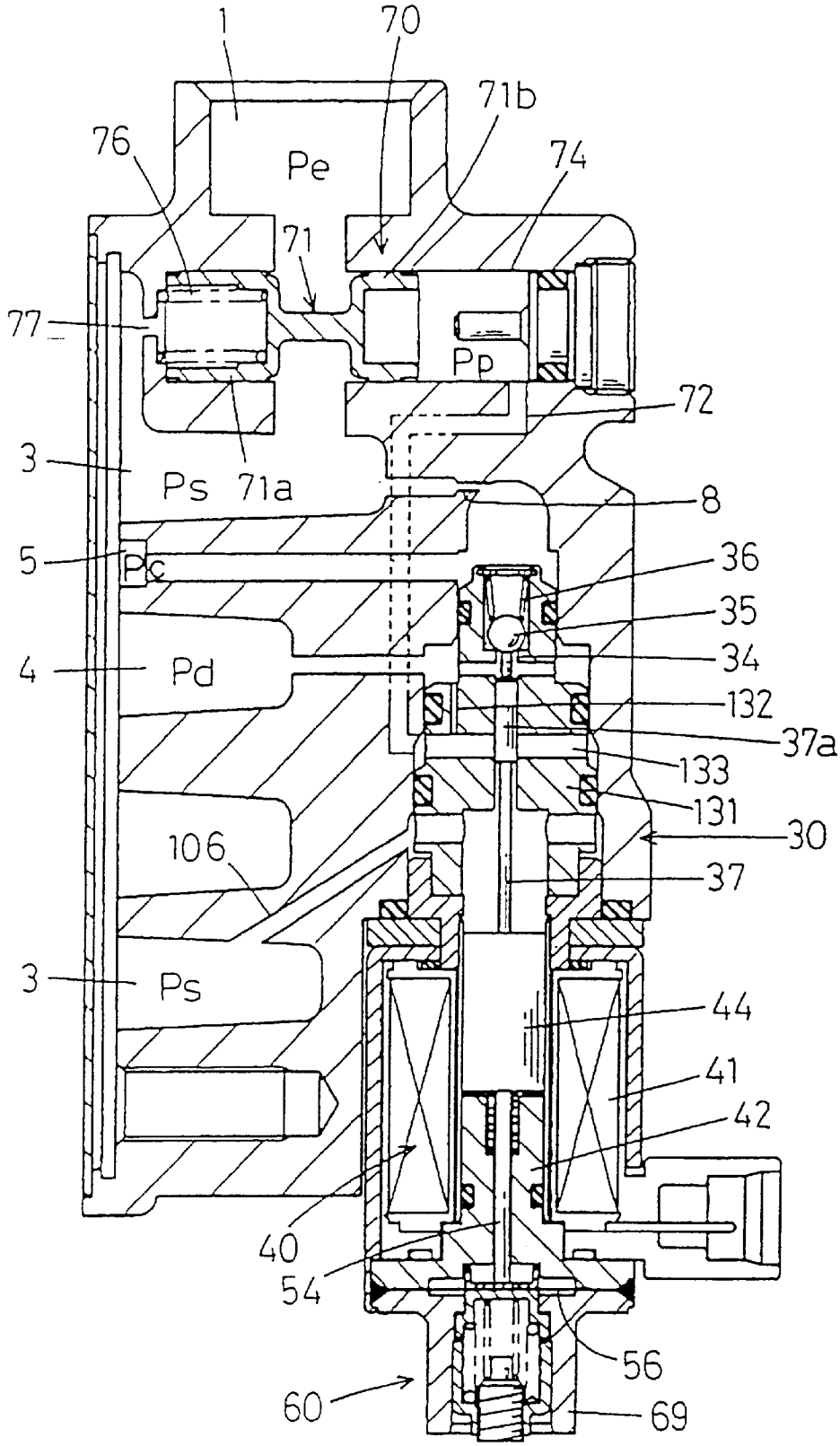
FIGS. 27 and 28 longitudinal sectional views of a further embodiment of a valve combination in a state of intermediate displacement and in a state of minimum operation, respectively.
Figure 28:
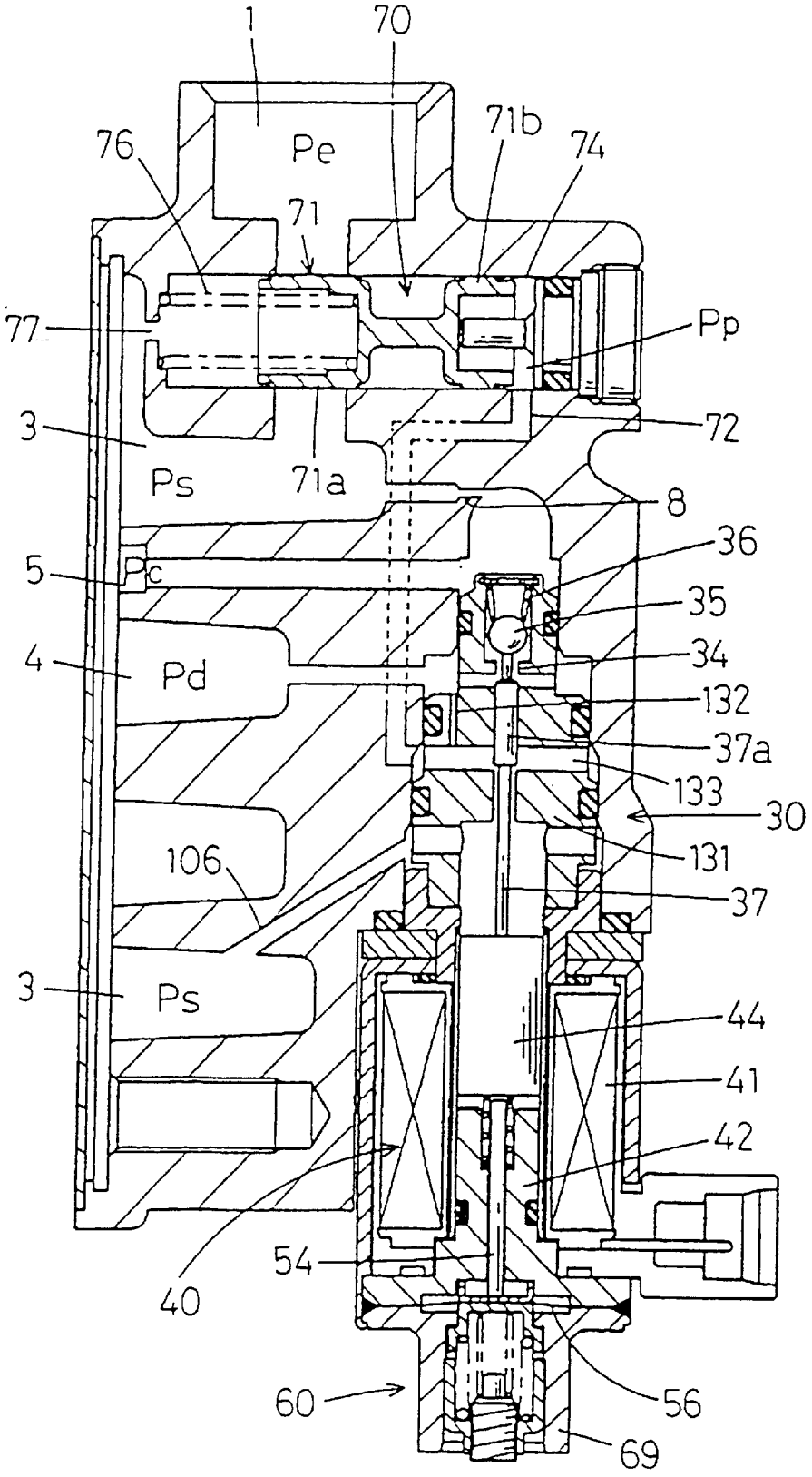

In the embodiment of the valve combination as shown in FIGS. 27 and 28 (FIG. 27: control condition in the state of intermediate displacement; FIG. 28: control condition at the minimum operation state in which the state of the minimum displacement is maintained) main valve 71 is loaded in its closing direction by compression coil spring 76. When (FIG. 27) pressure Pp in cylinder chamber 74 is high, main valve 71 is retracting into its open state. In case that the pressure Pp is low (FIG. 28) main valve 71 is brought into its closed state. Moreover, suction pressure Ps is applied to the inner surface of diaphragm 56 via connecting passage 106 like in the preceding embodiment. The peripheral part of diaphragm 56 is located between fixed iron core 42 and the flange 69 of the pressurising mechanism and is fixed by laser welding, etc., from the exterior side. In body tube 131 of the solenoid control valve 30 a restriction hole 132 is connecting a central side hole 133 permanently connected to main valve driving connecting hole 72 and the part connected to the discharge chamber part 4 with a small sectional area. Valve rod 37*a* is designed, e.g. with a shoulder, in order to open to close a passage between the central side hole 133 and the suction chamber part 4 depending on the stroke position of valve driving rod 37.

When the solenoid 40 is energized and generates magnetic power drawing moveable iron core 44 in a direction towards fixed iron core 42 (FIG. 27) the passage between central side hole 133 and suction chamber part 3 is closed by the shoulder of valve rod portion 37*a*. Central side hole 133 connected to discharge chamber part 4 via a restriction hole 132 has the discharge pressure Pd. Pressure Pp in cylinder chamber 74 is equalised via main valve driving hole 72 to the discharge pressure Pd (Pp=Pd), so that valve 70 is brought into an open state. In this state when valve rod 37 slightly is moved due to a displacement of diaphragm 56 caused by differential pressure between Ps and the atmospheric pressure, valve 35 will be pushed open by valve driving rod 37. Connecting passage 5 becomes connected to discharge chamber part 4. Pressure Pc in the crank chamber 12 rises. When valve 35 is pushed against valve hole 34 (closed state) pressure Pc in the crank chamber 12 will fall, since crank chamber 12 is connected to suction chamber part 3. As a consequence, the amount of discharge (the displacement) automatically is controlled.

Since the opening or closing timing of valve 35 is shifting in correspondence to the value of the energising current supplied to electromagnetic coil 41 the amount of discharge can be arbitrarily shifted corresponding to the value of suction pressure Ps.

When the solenoid 40 is de-energized (FIG. 28) valve 35 is pushed wide open by valve driving rod 37. Connecting passage 5 and discharge chamber part 4 are completely connected with another. Since then Pc equals Pd the minimum operation state is achieved. At the same time the movement of valve rod portion 37*a* is connecting the central side hole 133 to the suction chamber part 3. Pressure Pp becomes equal to the suction pressure Ps via the main valve driving connecting hole 72 (Pp=Ps). Valve 70 is closed. In that state discharge chamber part 4 and suction chamber part 3 are connected with another by restriction hole 8. A reflux hole 79 as used in other embodiments is not needed. As a consequence, the structure of the valve combination is very simple.

Figure 29:
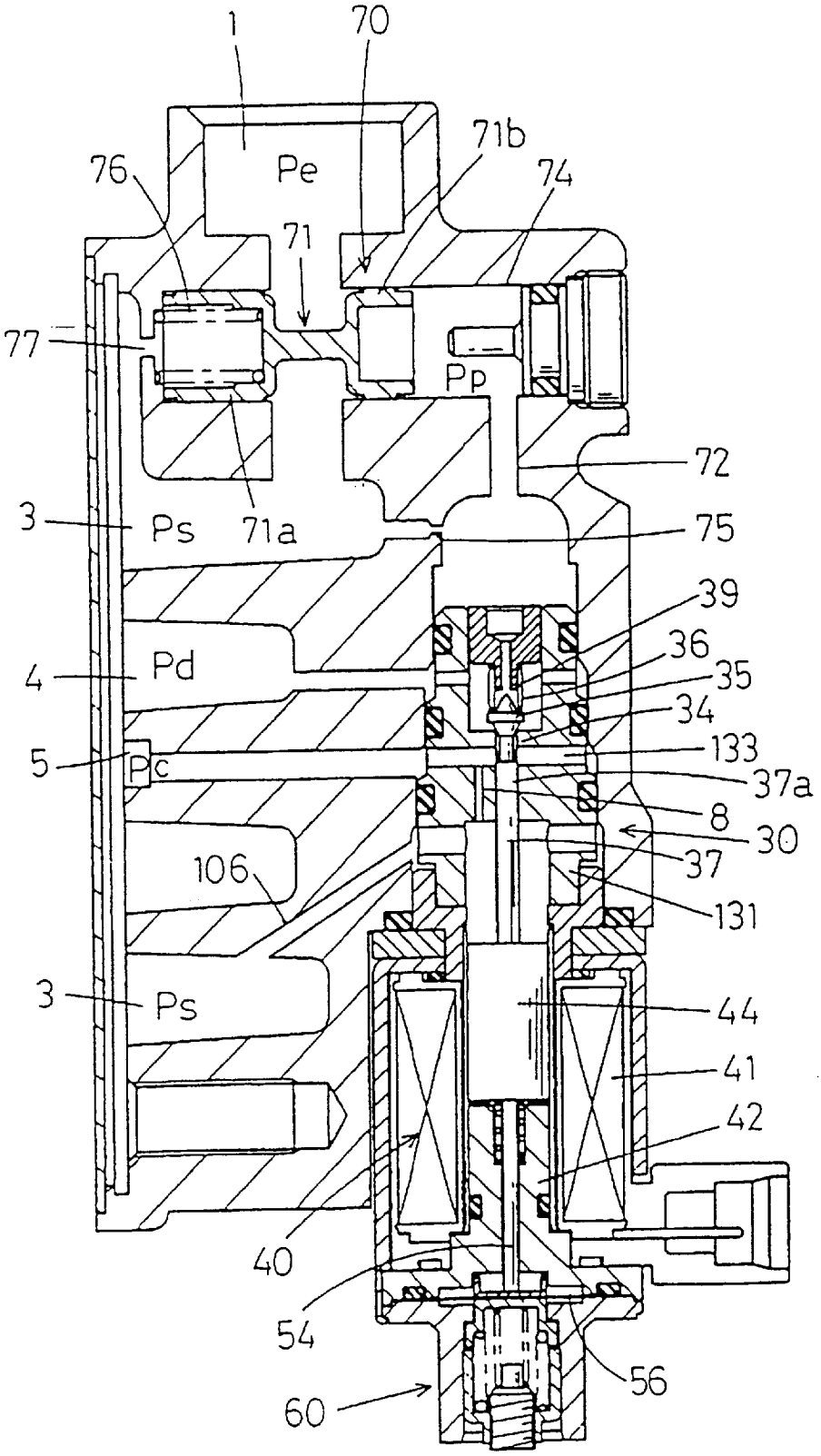
FIGS. 29 and 30 longitudinal sectional views of a further embodiment of a valve combination, in a state of minimum operation and a state of intermediate displacement, respectively.
Figure 30:
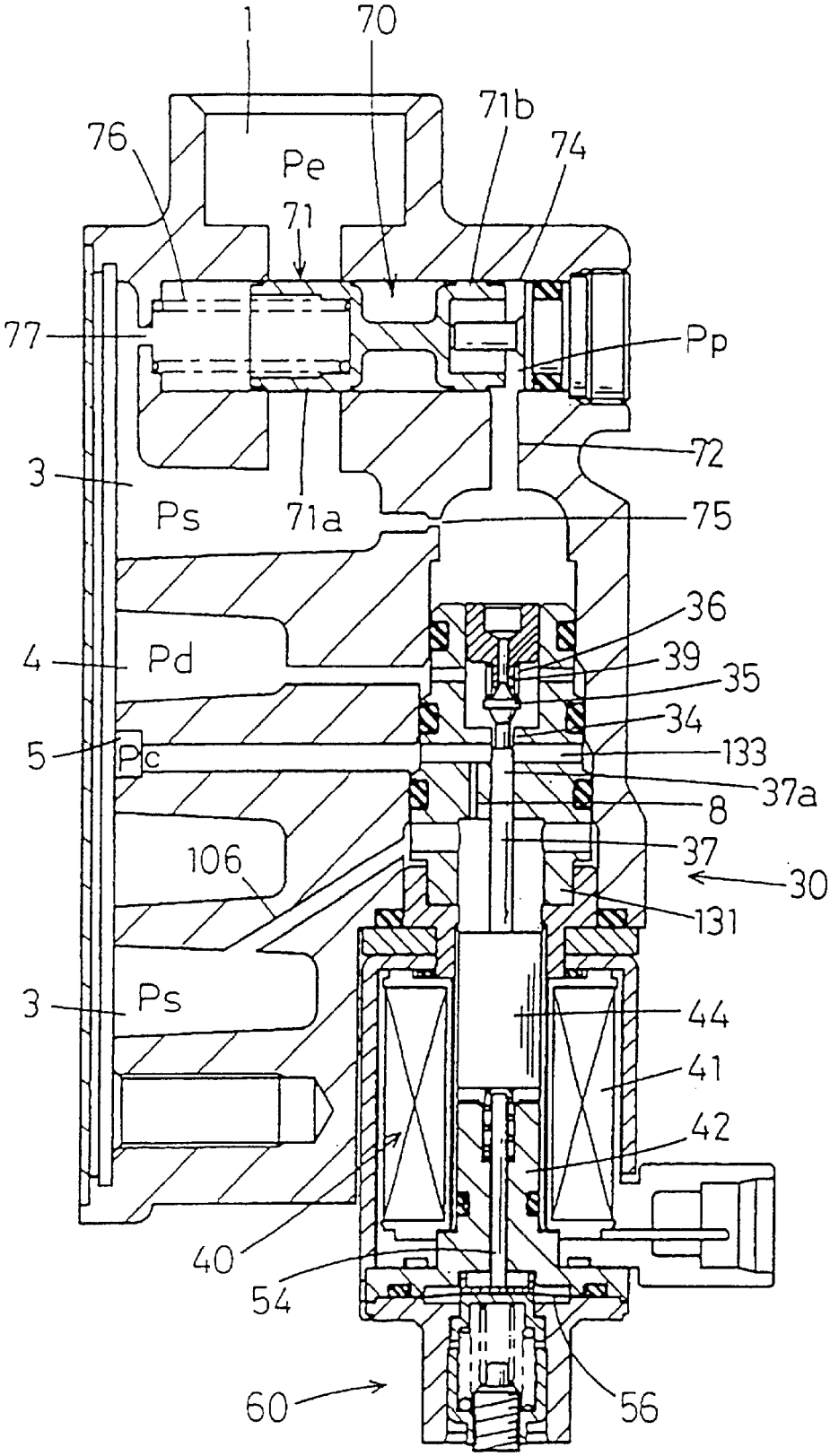

In the embodiment of the valve combination according to FIGS. 29 and 30 (FIG. 29: control condition at the state of intermediate displacement; FIG. 30: control condition at the minimum operation state where a state of minimum displacement is maintained) the piping provided upstream and downstream of valve 35 is reversed compared with the preceding embodiment (to a piping arrangement as in one of the preceding embodiments). The structure of valve 35 is the same as in the embodiment of FIG. 8. As a consequence, the inside of cylinder chamber 74 of valve 70 permanently is connected to suction chamber part 3 via main valve driving connecting hole 72 and restriction hole 75. Communication between suction chamber part 3 and cylinder chamber 74 is opened or blocked by valve 35, the upper and lower portions of which have conical shapes in this embodiment. Central side hole 133 permanently is connected to connecting passage 5. Restriction hole 8 formed in the body tube 131 of solenoid controlled valve 30 is formed to open a passage between the central side hole 133 and suction chamber part 3. Suction pressure Ps is applied to the inner surface of diaphragm 56 by way of connecting passage 106.

According to FIG. 29 with the solenoid 40 energized the magnetic force causes a pulling force for the moveable iron core 44 towards the fixed iron core 42, valve 35 is open. Pressure Pp in cylinder chamber 74 becomes equal to discharge pressure Pd via main valve driving connecting hole 72 (Pp=Pd). Valve 70 is brought into an open state. If in this state valve 35 slightly moves due to a displacement of the diaphragm 56 caused by the differential pressure between suction pressure Ps and the atmospheric pressure valve 35 is departing from valve hole 34. Then connecting passage 5 is connected to discharge chamber part 4 and the pressure Pc in crank chamber 12 will rise. If valve 35 is closing valve hole 34, pressure Pc in crank chamber 12 will fall caused by restriction hole 8. As a consequence, the amount of discharge (of displacement) automatically is controlled.

The opening or closing timing of valve 35 can be shifted in correspondence to the value of the energising current for solenoid 40. As a consequence, the amount of discharge corresponding to the value of suction pressure Ps arbitrarily can be shifted as well.

With solenoid 40 de-energized (FIG. 30) valve 35 will open to a great extent so that connecting passage 5 and discharge chamber part 4 will be connected unrestrictedly with another. Thus, the minimum operation state is achieved (Pc=Pd).

At the same time valve 35 is closing valve seat 39. So pressure Pp in cylinder chamber 74 becomes equal to suction pressure Ps via the main valve driving connecting hole 72 and restriction hole 75 (Pp=Ps). Valve 70 is closed.

The present invention is not limited to the embodiments as shown and described. It can be realised in any mode, provided that, when the solenoid 40 of the solenoid controlled valve 30 is de-energized, the variable displacement compressor 10 will fall into the minimum operation state, and in response to that, the valve 70 will close the suction passage between the low-pressure refrigerant pipe conduit 1 and the suction chamber part 3. The invention cannot only be applied to a variable displacement compressor having a swing or wobble plate, as shown, but also to various types of variable displacement compressors like a rotary type—or a scroll type variable displacement compressor, etc.

Figure 31:
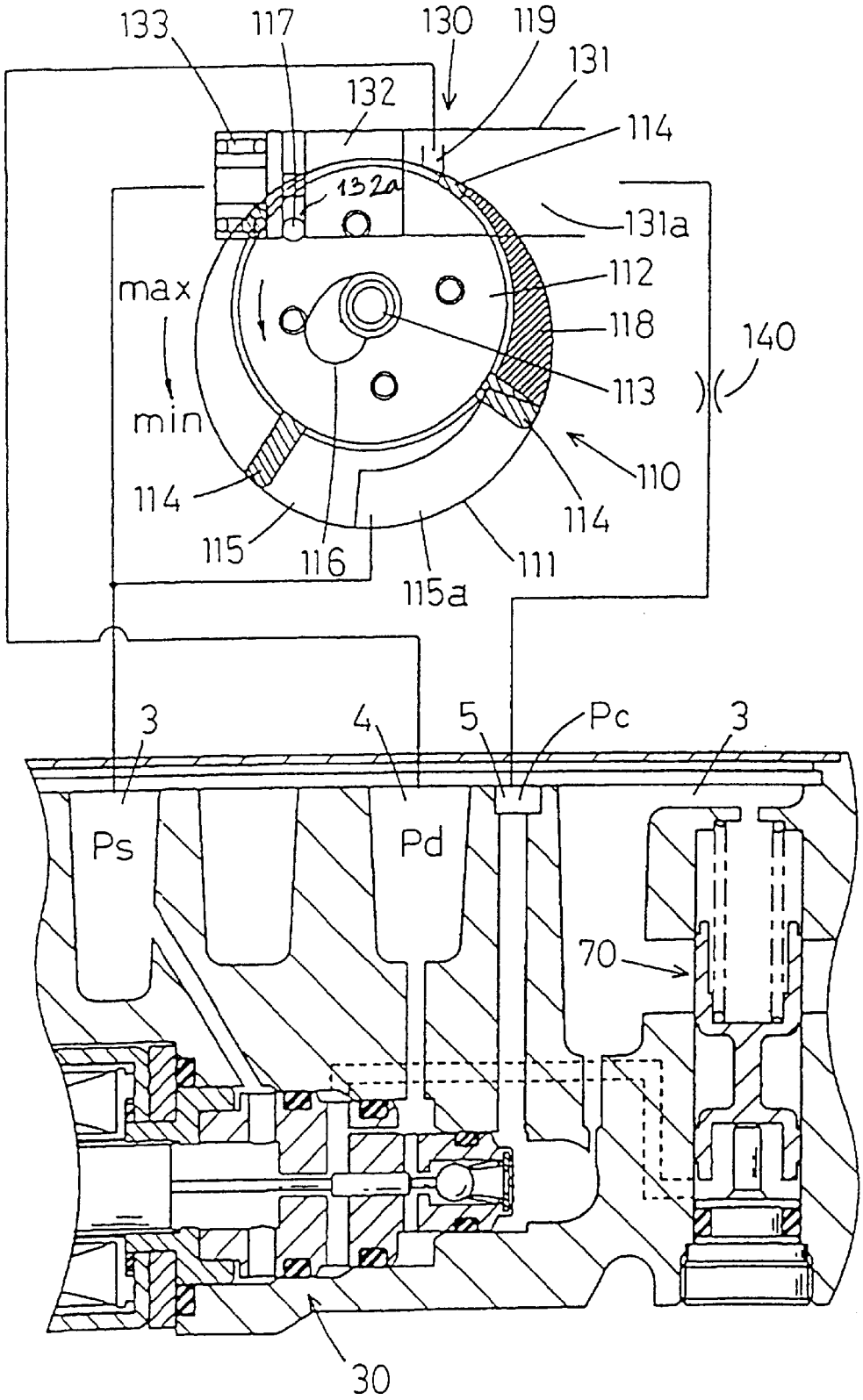
FIG. 31 a schematic representation of a variable displacement compressor of another type combined with a further embodiment of a valve combination, in a state of minimum displacement.

In FIG. 31 a variable displacement compressor 110 of a rotary type is equipped with the solenoid controlled valve 30 for displacement control and the valve 70 as shown in FIGS. 27 and 28. FIG. 31 is representing the minimum operation state. The variable displacement compressor 110 shown is already known. In a circular housing 111 a circular rotor 112 of smaller size than the housing is arranged so as to be centred on an eccentric axis 113 which is driven for rotation by an engine, etc., not shown. At the periphery of rotor 112 with intervals of 90° four seal members 114 are arranged which are loaded by springs (not shown) towards the outer side so as to be in permanent contact with the inner surface of housing 111. The inner surface of the housing 111 and the outer surface of rotor 112 are almost in contact with another at one rotary position of the rotor where the outer surface of rotor 112 approaches the inner surface of housing 111 nearest. In this region a discharge opening 119 is formed through which compressed refrigerant is discharged. Adjacent rotor 112 a suction opening control plate 115 is rotatably provided in contact with housing 111. A suction opening 115*a* in suction opening control plate 115 is connected to suction chamber part 3. The low-pressure refrigerant is sucked into compressor 110. On suction opening control plate 115 a protruding driving pin 117 is provided driven by a displacement varying mechanism 130. Pin 117 allows to change the position of suction opening control plate 115 causing displacement of the suction opening 115*a*. In plate 115 a hole 116 is formed with a deformed circular shape in order to avoid interference with eccentric axis 113. Mechanism 130 includes a piston 132 in a cylinder 131 for reciprocal movement along the axis of the cylinder. The driving pin 117 is engaging into a ditch 132*a* formed on the surface of piston 132.

One side of cylinder 131 is connected to suction chamber part 3 so that the pressure in cylinder 131 is equal to suction pressure Ps. Inside the pressure chamber a pressure control spring 133 is provided actuating piston 132. The other end of cylinder 131 is defining a pressure control chamber 131*a* connected to connecting passage 5. The internal pressure Pc of pressure control chamber 131*a* is controlled by solenoid controlled valve 30. The amount of discharge (displacement) of the variable displacement compressor 110 of the rotary type is varied by changing the position of suction opening control plate 115 in correspondence to pressure Pc inside pressure control chamber 131*a*. A control function is executed which is quite similar to the control function as described for the variable displacement compressor of the swing plate type, namely by solenoid controlled valve 30 and valve 70 according to the invention.

Figure 32:
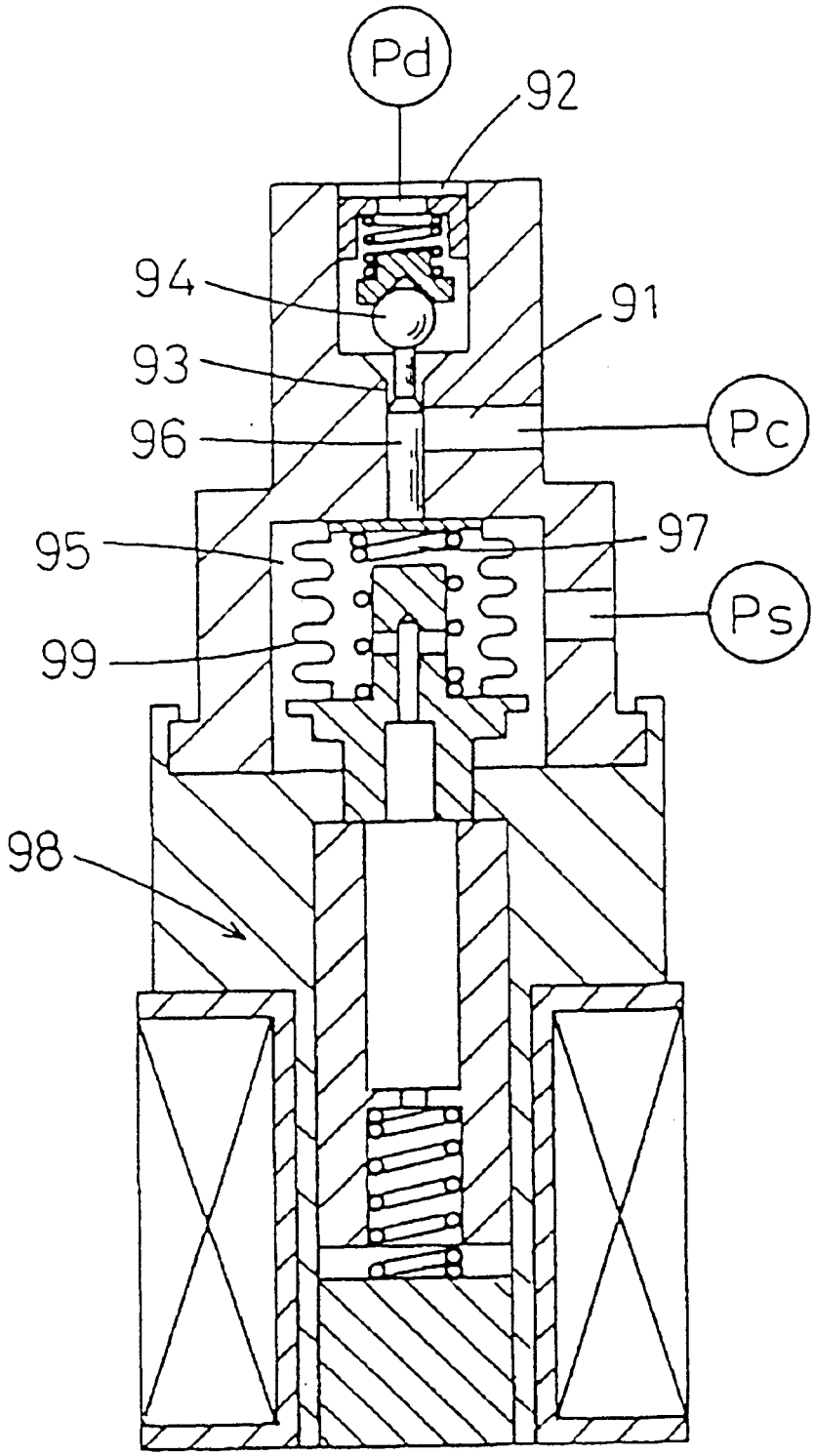
FIG. 32 a longitudinal sectional view of a conventional solenoid controlled valve (prior art) of a displacement control apparatus.

FIG. 32 is representing a prior art solenoid controlled valve of a conventional displacement control apparatus for a variable displacement compressor. A crank chamber connecting part 91 is connected to a discharge chamber connecting part 92 via a valve hole 93. Valve closure member 94 is co-operating with valve hole 93 for opening and closing valve hole 93. Adjacent to crank chamber connecting part 91 a suction chamber connecting part 95 is provided at a side opposite to the side where the discharge chamber connecting part 92 is connected. Pd represents the discharge chamber pressure, Pc represents the crank chamber pressure, and Ps represents the suction chamber pressure. A spring 97 is urging valve pressure member 94 in opening direction and via a valve driving rod 96 penetrating valve hole 93. A solenoid 98 serves to generate electromagnetic force to drive valve driving rod 96 downwardly to close valve 93, 94. In suction chamber connecting part 95, especially between the solenoid 98 and crank chamber connecting part 91, a pressure sensitive part 99 is provided. The pressure sensitive part 99 comprises a bellows connected to the moveable core of the solenoid 98 and the spring 97 inside the bellows. Both the bellows and the spring 97 are co-acting with a plate co-operating with valve driving rod 96. A certain pressure inside the bellows may define a predetermined reference pressure. The pressure sensitive part 99 responds to the differential pressure between said predetermined reference pressure and pressure Ps to move valve driving rod 96 to close (or open) valve 93, 94. By this structure, opening and closing of valve 93, 94 is controlled by pressure sensitive part 99 operating in correspondence of pressure Ps whereby the displacement of the compressor is controlled. The value of pressure Ps responsible for opening or closing valve 93, 94 can be varied by changing the value of the energising current for solenoid 98. In order to minimise the displacement of the compressor the solenoid 98 is de-energized, thereby maximising the possible stroke of valve 93, 94. However, even in such a state the force of pressure sensitive part 99 is acting on valve driving rod 96 causing to open or close valve 93, 94 even with solenoid 98 de-energized and still in correspondence to variations of pressure Ps in the suction chamber. This means that the compressor cannot be maintained safely in a steady operation state of the minimum displacement. It is necessary to provide a clutch or the like at the drive side of the compressor resulting in an increase of production costs and the dimension of the entire arrangement. Moreover, the bellows used in the pressure sensitive part 99 consumes large space and requires undesirable big dimensions of the solenoid controlled valve.

What is claimed is:

1. A variable displacement compressor comprising:

a low pressure refrigerant pipe conduit connected to a suction chamber, wherein the compressor sucks refrigerant from the low pressure refrigerant conduit into the suction chamber, compresses and thereafter discharges the refrigerant into a discharge chamber connected to a high pressure refrigerant pipe conduit;

wherein the compressor changes the amount of discharge of the refrigerant in accordance with a change of the pressure in a pressure control chamber of the compressor, wherein the pressure is controlled by a solenoid controlled valve;

a suction passage between the low pressure refrigerant pipe conduit and a suction chamber part, wherein the suction passage contains a suction passage valve for opening and closing the suction passage; and wherein the suction passage valve is controlled by the solenoid controlled valve to close the suction passage when a solenoid of the solenoid controlled valve is de-energized, wherein the de-energized solenoid controlled valve simultaneously controls the amount of discharge of the refrigerant to a minimum state.

2. A variable displacement compressor according to claim 1, the solenoid controlled valve further comprising:

a valve mechanism for changing the pressure in the pressure control chamber of the compressor in correspondence to a change of refrigerant pressure in the low pressure refrigerant pipe conduit or to a change of the refrigerant pressure in the suction chamber part; and wherein the solenoid of the solenoid controlled valve is supplied with current for adjusting the value of the pressure in the pressure control chamber corresponding either to a value of the refrigerant pressure in the low pressure refrigerant pipe conduit or the refrigerant pressure in the suction chamber part.

3. A variable displacement compressor according to claim 1, the suction passage valve further comprising:

a valve part for opening and closing the suction passage;

a unitary driving piston body received in a cylinder chamber;

wherein the valve part is spring-loaded in parallel to the pressure in the suction chamber part in a closing direction;

wherein the cylinder chamber communicates with the suction chamber part via a restrictor, and the cylinder chamber further communicates via the energized solenoid control valve with the discharge chamber part to maintain the suction passage valve in an open state by pressurizing the cylinder chamber and the driving piston body counter to the force of a spring and the pressure in the suction chamber part;

wherein when the solenoid control valve is de-energized, the solenoid control valve blocks the communication between the discharge chamber part and the cylinder chamber by allowing pressure equalization between the suction chamber part and the cylinder chamber via the restrictor and brings the suction passage valve into a closed state by the spring force of the spring.

4. A variable displacement compressor according to claim 1, the suction passage valve further comprising:

a valve part for opening and closing the suction passage;

a unitary driving piston body received in a cylinder chamber;

wherein the valve part is spring-loaded in an opening direction;

wherein the cylinder chamber further communicates via the de-energized solenoid controlled valve with the discharge chamber part to maintain the suction passage valve in a closed state by pressurizing the cylinder chamber and the driving piston body and the valve part in an opening direction counter to the force of a spring and the pressure in the suction chamber part;

wherein when the solenoid controlled valve is energized, the solenoid controlled valve blocks the communication between the discharge chamber part and the cylinder chamber allowing pressure equalization between the suction chamber part and the cylinder chamber via the restrictor and brings the suction passage valve into an opened state by the spring force of the spring.

5. A variable displacement compressor according to claim 4, wherein the control pressure chamber and the discharge chamber part are connected by a leakage passage.

6. A variable displacement compressor according to claim 1, wherein the suction passage valve includes a valve part for opening and closing the suction passage and a driving piston directly coupled with the valve part, both having equal pressure receiving areas, the driving piston body slidably situated in a cylinder chamber to divide the cylinder chamber into a first inner part and a second outer part;

wherein a spring in the second outer cylinder chamber part loads the driving piston body and the valve part in a closing direction of the suction passage valve;

wherein a communication hole inside the valve part and the driving piston body permanently interconnects the suction chamber part and the second outer cylinder chamber part;

wherein a restriction hole in the driving piston body connects the first inner and the second outer cylinder chamber part, and the first inner cylinder chamber part further communicates via the energized solenoid controlled valve with the discharge chamber part to maintain the suction passage valve in an open state by pressurizing the first inner cylinder chamber part, the driving piston body and the valve part in an opening direction counter to a spring;

wherein when the solenoid control valve is de-energized, the solenoid control valve blocks the communication between the discharge chamber part and the first inner cylinder chamber part allowing pressure equalization between the first inner and the second outer cylinder chamber parts via the restriction hole and the communication hole and brings the suction passage valve into a closed state by the spring force of the spring.

7. A variable displacement compressor according to claim 6, wherein the control pressure chamber and the discharge chamber part are connected by a leakage passage.

8. A variable displacement compressor according to claim 1, wherein the suction passage valve is formed with a reflux passage interconnecting the low pressure refrigerant conduit pipe and the discharge chamber part when the suction passage valve is maintained in a closed state, the reflux passage being blocked when the suction passage valve is in an open state.

* * * * *